US006484950B2

(12) United States Patent
Hirota et al.

(10) Patent No.: US 6,484,950 B2
(45) Date of Patent: Nov. 26, 2002

(54) EXPANSION VALVE

(75) Inventors: Hisatoshi Hirota, Tokyo (JP); Isao Sendo, Tokyo (JP); Kuniharu Baba, Tokyo (JP); Takeshi Kaneko, Tokyo (JP)

(73) Assignee: TGK Co. Ltd., Tokyo (JP)

( * ) Notice: Subject to any disclaimer, the term of this patent is extended or adjusted under 35 U.S.C. 154(b) by 0 days.

(21) Appl. No.: 09/992,343

(22) Filed: Nov. 6, 2001

(65) Prior Publication Data

US 2002/0060250 A1 May 23, 2002

(30) Foreign Application Priority Data

Nov. 21, 2000 (JP) ..... 2000-353672
Jan. 31, 2001 (JP) ..... 2001-022792

(51) Int. Cl.[7] ..... F25B 41/04

(52) U.S. Cl. ..... 236/92 B; 62/225; 62/299; 137/315.11; 137/454.2

(58) Field of Search ..... 236/92 B; 62/225, 62/299; 137/315.11, 454.2

(56) References Cited

U.S. PATENT DOCUMENTS 3,627,258 A * 12/1971 Scaramucci ..... 137/454.2
4,203,468 A * 5/1980 Dietz ..... 137/454.2
4,336,824 A * 6/1982 Steineman ..... 137/315.11
4,342,421 A 8/1982 Widdowson ..... 236/92
4,982,579 A 1/1991 Suzuki et al. ..... 62/515
5,127,237 A * 7/1992 Sendo et al. ..... 236/92 B
5,653,256 A * 8/1997 Myers et al. ..... 137/234.5
5,724,817 A 3/1998 Nishishita ..... 62/216
6,062,484 A * 5/2000 Eybergen ..... 236/92 B
6,112,998 A * 9/2000 Taguchi ..... 236/92 B

FOREIGN PATENT DOCUMENTS

EP 0 691 517 1/1996
JP 10-300280 11/1998
JP 11-210926 8/1999

* cited by examiner

*Primary Examiner*—William E. Tapolcai
(74) *Attorney, Agent, or Firm*—Nilles & Nilles, S.C.

(57) ABSTRACT

To provide an expansion valve which permits both the assembling cost and the cost of parts to be effectively reduced by a large margin and thus is highly economical. A high-pressure refrigerant pipe, a valve casing and a low-pressure refrigerant pipe are previously formed integrally with an evaporator. At the time of assembling, an expansion valve unit having a minimum function to serve as an expansion valve is inserted into the valve casing and fixed thereto by a clip, and a distal end portion of a temperature sensing cylinder is fixed to an outlet pipe of the evaporator, thereby constructing an expansion valve. No special joints are required to connect the expansion valve unit to the high-pressure and low-pressure refrigerant pipes, and therefore, the cost of parts can be cut down. Also, since the valve casing into which the expansion valve unit is fitted is formed integrally with the high-pressure and low-pressure refrigerant pipes and the evaporator, no pipe connection is required, thus reducing the assembling cost.

20 Claims, 32 Drawing Sheets

EXPANSION VALVE

BACKGROUND OF THE INVENTION (1) Field of the Invention

The present invention relates to an expansion valve, and more particularly, to an expansion valve which is responsive to the temperature of refrigerant delivered to a compressor from an evaporator in a refrigeration cycle to control the quantity of the refrigerant introduced into the evaporator.

(2) Description of the Related Art

In an air conditioning system for automobiles, a refrigeration cycle is constructed in which high-temperature high-pressure gaseous refrigerant compressed by a compressor is condensed in a condenser and the resulting high-pressure liquid refrigerant is adiabatically expanded in an expansion valve to obtain low-temperature low-pressure liquid refrigerant, which is then evaporated in an evaporator and returned to the compressor. The evaporator, to which the low-temperature refrigerant is supplied, exchanges heat with the air in the vehicle compartment, whereby the compartment is air-cooled.

The expansion valve includes a temperature-sensitive chamber of which the internal pressure rises or drops in response to temperature changes of the refrigerant in a low-pressure refrigerant passage connected to the outlet of the evaporator, and a valve mechanism actuated in response to pressure rise or drop of the temperature-sensitive chamber to control the flow rate of the refrigerant supplied to the inlet of the evaporator. The valve mechanism is housed in a valve casing, whose refrigerant inlet and outlet are respectively connected by fastening members, such as nuts, to a high-pressure refrigerant pipe and a low-pressure refrigerant pipe leading to the evaporator. A temperature sensing cylinder is connected to the temperature-sensitive chamber and has a distal end portion thereof closely fixed to a refrigerant pipe connected to the outlet of the evaporator to sense the temperature of the refrigerant at the outlet of the evaporator.

Originally expansion valves are designed to detect not only the temperature but the pressure of the refrigerant at the outlet of the evaporator so that the valve mechanism may be controlled also in response to variations in the pressure. There has, however, been a demand for expansion valves reduced in cost. To meet the demand, an expansion valve has been developed which senses only the temperature of the refrigerant at the outlet of the evaporator, as mentioned above, and in which a joint between the refrigerant pipe connected to the outlet of the evaporator and the refrigerant pipe leading to the compressor is omitted to cut down the cost. This arrangement is based on the fact that, when the refrigerant from the expansion valve passes through the evaporator, its pressure loss within the evaporator is almost constant and thus a pressure obtained by subtracting the pressure loss from the pressure at the outlet of the expansion valve can be regarded as the pressure of the refrigerant at the outlet of the evaporator.

Even in this temperature sensing type expansion valve which requires no connection of refrigerant pipes on the outlet side of the evaporator, it is necessary that the high-pressure refrigerant pipe and the low-pressure refrigerant pipe leading to the evaporator should be connected, respectively, to the refrigerant inlet and outlet of the valve casing by fastening members when the expansion valve is assembled. Accordingly, there has been a demand for expansion valves which are further reduced in cost, inclusive of the assembling cost.

SUMMARY OF THE INVENTION

The present invention was created in view of the above circumstances, and an object thereof is to provide an expansion valve which permits both the assembling cost and the cost of parts to be effectively reduced by a large margin and thus is highly economical.

To accomplish the above object, according to the present invention, there is provided an expansion valve for sensing temperature change of a refrigerant at an outlet of an evaporator to control a flow rate of the refrigerant supplied to an inlet of the evaporator. The expansion valve comprises an expansion valve unit including a temperature-sensitive chamber whose internal pressure rises or drops in response to temperature change of the refrigerant in a low-pressure refrigerant pipe connected to the outlet of the evaporator, and a valve mechanism actuated in response to pressure rise or drop of the temperature-sensitive chamber to control the flow rate of the refrigerant supplied to the inlet of the evaporator, a valve casing having an opening into which said expansion valve unit is fitted, said valve casing being formed integrally with a high-pressure refrigerant pipe for introducing the high-pressure refrigerant, a low-pressure refrigerant pipe for letting out the refrigerant whose flow rate has been controlled, and the evaporator and fixing means for fixing said expansion valve unit fitted into said valve casing.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Embodiments of the present invention will be hereinafter described in detail with reference to the drawings.

Figure 1:
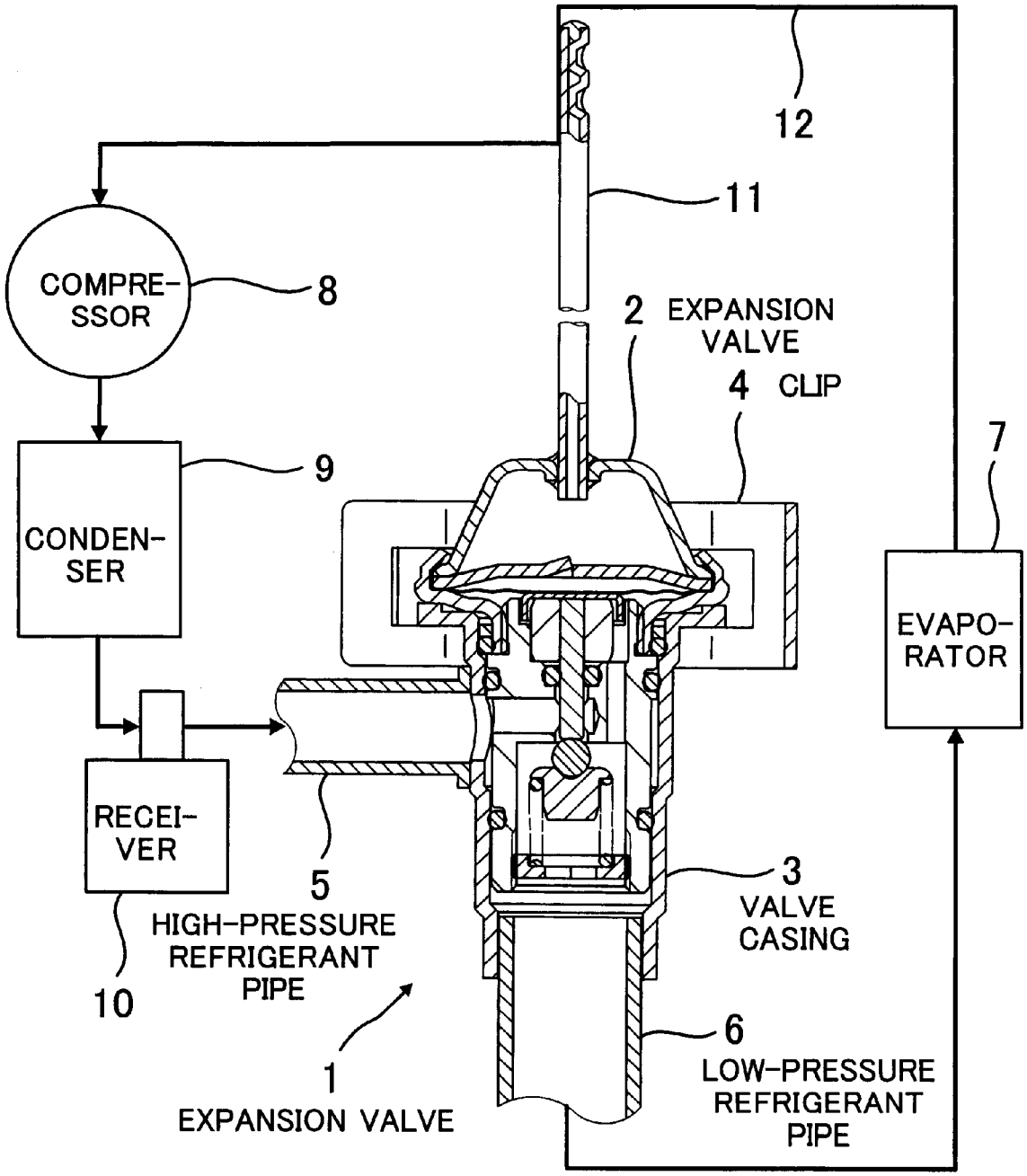
FIG. 1 is a diagram showing a refrigeration cycle using an expansion valve according to a first embodiment of the present invention.

FIG. 1 is a diagram illustrating a refrigeration cycle using an expansion valve according to a first embodiment of the present invention.

The expansion valve 1 of the present invention comprises an expansion valve unit 2 having a minimum function to serve as an expansion valve, a valve casing 3 for receiving the expansion valve unit 2, a clip 4 for fixing the valve casing 3 and the expansion valve unit 2 to each other, and high-pressure and low-pressure refrigerant pipes 5 and 6 welded to the valve casing 3. The low-pressure refrigerant pipe 6 of the expansion valve 1 is connected to the high-pressure refrigerant pipe 5 through an evaporator 7, a compressor 8, a condenser 9 and a receiver 10, and a temperature sensing cylinder 11 of the expansion valve unit 2 is thermally coupled to an outlet pipe 12 of the evaporator 7, whereby a refrigeration cycle is constructed.

The individual components constituting the expansion valve 1 will be now described.

Figure 2:
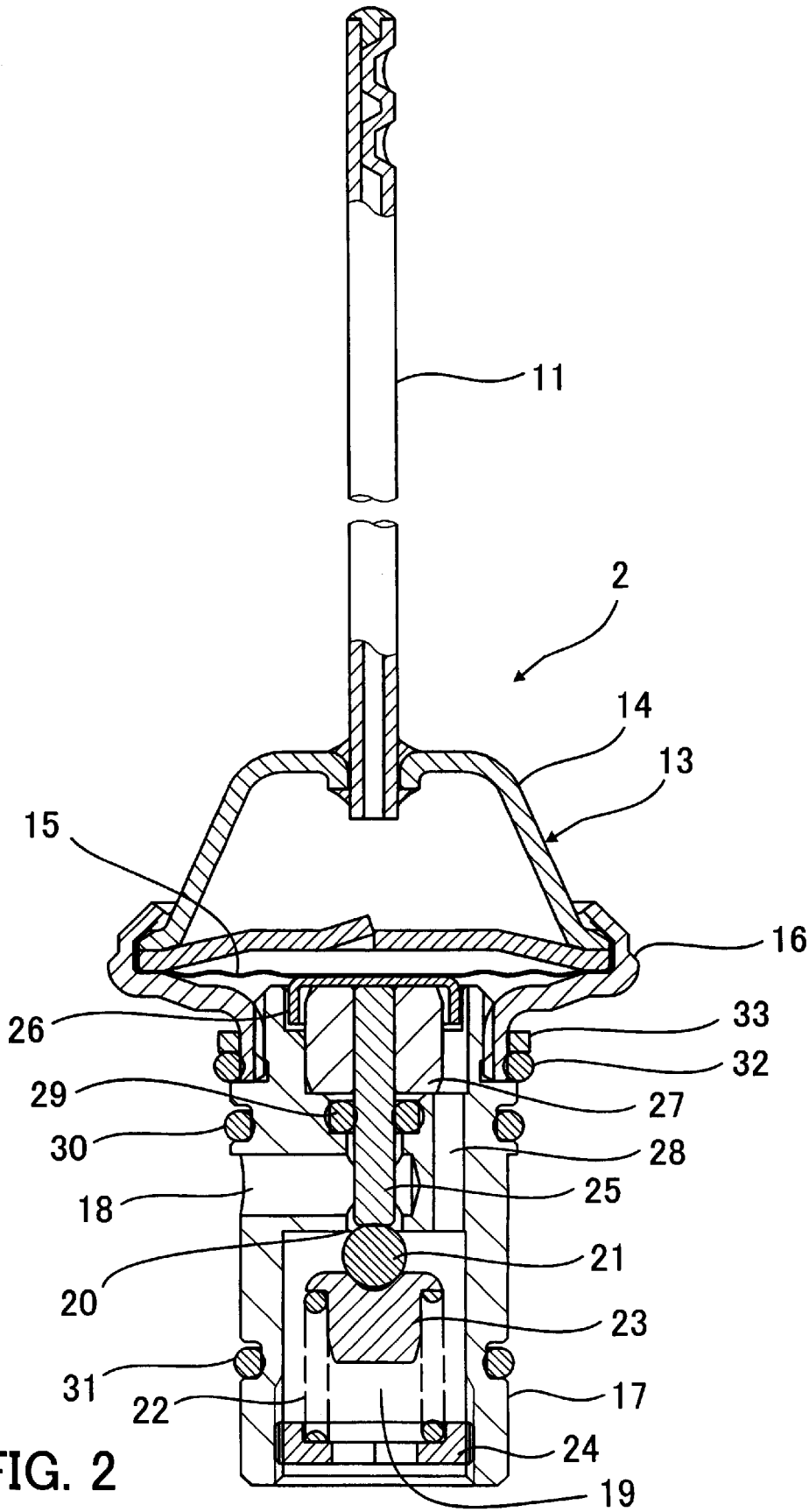
FIG. 2 is a longitudinal sectional view showing the construction of an expansion valve unit.

FIG. 2 is a longitudinal sectional view showing the construction of the expansion valve unit.

The expansion valve unit 2 has an integral structure comprising a temperature-sensitive chamber 13 whose internal pressure rises or drops in response to temperature change of a refrigerant flowing through the outlet pipe 12 of the evaporator 7, the temperature change being sensed by the temperature sensing cylinder 11, and a valve mechanism actuated in response to the pressure rise or drop of the temperature-sensitive chamber 13 to open and close a high-pressure refrigerant passage.

The temperature-sensitive chamber 13 has an internal space defined by a housing 14 made of a thick metal plate and a diaphragm 15 made of a thin flexible metal plate, and outer peripheral edges of these metal plates are caulked with a temperature-sensitive chamber mount 16 and then welded together to make the internal space airtight. The interior of the temperature-sensitive chamber is filled with a gas of saturated vapor state having identical or similar properties to the refrigerant which is a working fluid of the refrigeration cycle. The temperature sensing cylinder 11, which comprises a capillary tube, is brazed at top of the housing 14.

The temperature-sensitive chamber mount 16 has a lower end portion thereof screwed onto an upper portion of a body 17 of the valve mechanism. The body 17 has a high-pressure refrigerant passage 18 formed almost in the middle as viewed in a longitudinal direction thereof and extending from one side to the center thereof, and a low-pressure refrigerant passage 19 axially extending through a lower end portion thereof. A hole is formed in the body 17 along the axis thereof to connect the high-pressure refrigerant passage 18 to the low-pressure refrigerant passage 19, and an end of the hole on the same side as the low-pressure refrigerant passage 19 serves as a valve seat 20. A spherical valve element 21 is arranged so as to face the valve seat 20 and is pressed against the valve seat 20 by a compression coil spring 22 through a valve element support 23. The compression coil spring 22 has a base received in an adjusting screw 24. The adjusting screw 24 is screwed in along the inner wall of the low-pressure refrigerant passage 19, and by rotating the adjusting screw, it is possible to adjust the force of pressing the valve element 21.

A shaft 25 is axially movably inserted into the body 17 along the axis thereof, and has one end abutting against or welded to the valve element 21 and the other end abutting against the lower surface of the diaphragm 15 through a disk 26. The shaft 25 is also held by a holder 27 in alignment with the axis of the body 17.

In the body 17 is also formed a communication passage 28 for equalizing the pressure in a space beneath the diaphragm 15 of the temperature-sensitive chamber 13 with that in the low-pressure refrigerant passage 19. The space beneath the diaphragm 15 is sealed with an O ring 29 fitted on the shaft 25 to be isolated from the high-pressure refrigerant passage 18. O rings 30 and 31 are fitted around the outer periphery of the body 17 at locations above and below the high-pressure refrigerant passage 18, respectively, to seal the high-pressure refrigerant passage 18, the temperature-sensitive chamber 13 and the low-pressure refrigerant passage 19 off from each other when the expansion valve unit 2 is fitted into the valve casing 3. An O ring 32 is fitted around the outer periphery of the lower end portion of the temperature-sensitive chamber mount 16 to prevent the space beneath the diaphragm 15 from communicating with the atmosphere through a gap between threads by means of which the temperature-sensitive chamber mount 16 is attached to the body 17. A backup ring 33 is also fitted around the outer periphery of the lower end portion of the temperature-sensitive chamber mount 16 to restrict displacement of the O ring 32.

In the expansion valve unit 2 constructed as described above, the refrigerant supplied to the high-pressure refrigerant pipe 5 from the receiver 10 enters the high-pressure refrigerant passage 18, is adiabatically expanded as it passes through the gap between the valve seat 20 and the valve element 21, and then delivered from the low-pressure refrigerant passage 19 to the evaporator 7 through the low-pressure refrigerant pipe 6. The refrigerant output from the evaporator 7 is delivered to the compressor 8, and the temperature of the refrigerant at the outlet of the evaporator is sensed by the temperature sensing cylinder 11.

In response to the temperature thus sensed, the pressure of the gas filled in the temperature-sensitive chamber 13 varies, that is, the pressure in the chamber 13 rises or drops. On the other hand, the refrigerant in the low-pressure refrigerant passage 19 enters the space beneath the temperature-sensitive chamber 13 through the communication passage 28, so that the underside or lower side of the diaphragm 15 is acted upon by the refrigerant pressure in the low-pressure refrigerant passage 19. Thus, the diaphragm 15, the shaft 25 and the valve element 21 become stationary at a position where the refrigerant pressure, the pressure in the temperature-sensitive chamber 13 and the urging force of the compression coil spring 22 are equilibrated, thereby determining the quantity of the refrigerant delivered from the high-pressure refrigerant pipe 5 to the evaporator 7. As the temperature of the refrigerant at the outlet of the evaporator 7 increases, the pressure in the temperature-sensitive chamber 13 rises, so that the diaphragm 15 is displaced downward. This displacement of the diaphragm pushes down the valve element 21 through the shaft 25, increasing the valve opening and thus the flow rate of the refrigerant, whereby the temperature of the refrigerant at the outlet of the evaporator 7 is controlled in a decreasing direction. As the temperature of the refrigerant at the outlet of the evaporator 7 decreases, the individual elements operate in a manner opposite to the above, so that the temperature of the refrigerant at the outlet of the evaporator 7 is controlled in an increasing direction.

Figure 3:
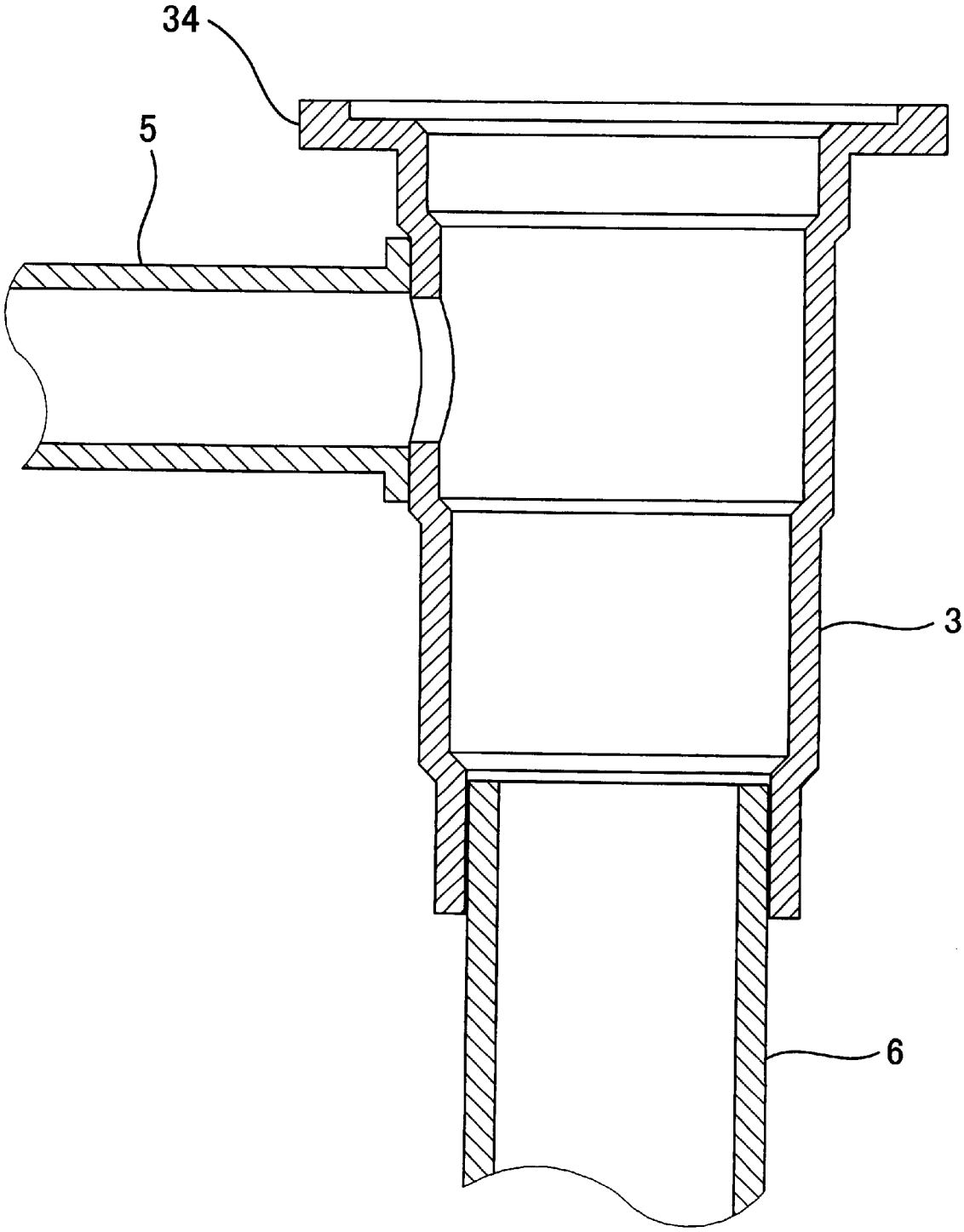
FIG. 3 is a longitudinal sectional view of a valve casing into which the expansion valve unit is fitted.

FIG. 3 is a longitudinal sectional view of the valve casing to which the expansion valve unit is attached.

The valve casing 3, into which the expansion valve unit 2 is fitted, is formed into a shape matching the external form of the expansion valve unit 2, and the expansion valve unit 2 is inserted into the valve casing from an opening shown in the upper part of the figure. A flange 34 is formed around the opening to allow the inserted expansion valve unit 2 to be fixed to the valve casing 3 by means of the clip 4.

The valve casing 3 is made of aluminum. When the evaporator 7, which is of a stacked type, is subjected to aluminum welding in a high-temperature room, the valve casing also is subjected to aluminum welding together with the high-pressure and low-pressure refrigerant pipes 5 and 6 in the high-temperature room, to form the valve casing integrally with the high-pressure and low-pressure refrigerant pipes 5 and 6.

Figure 4:
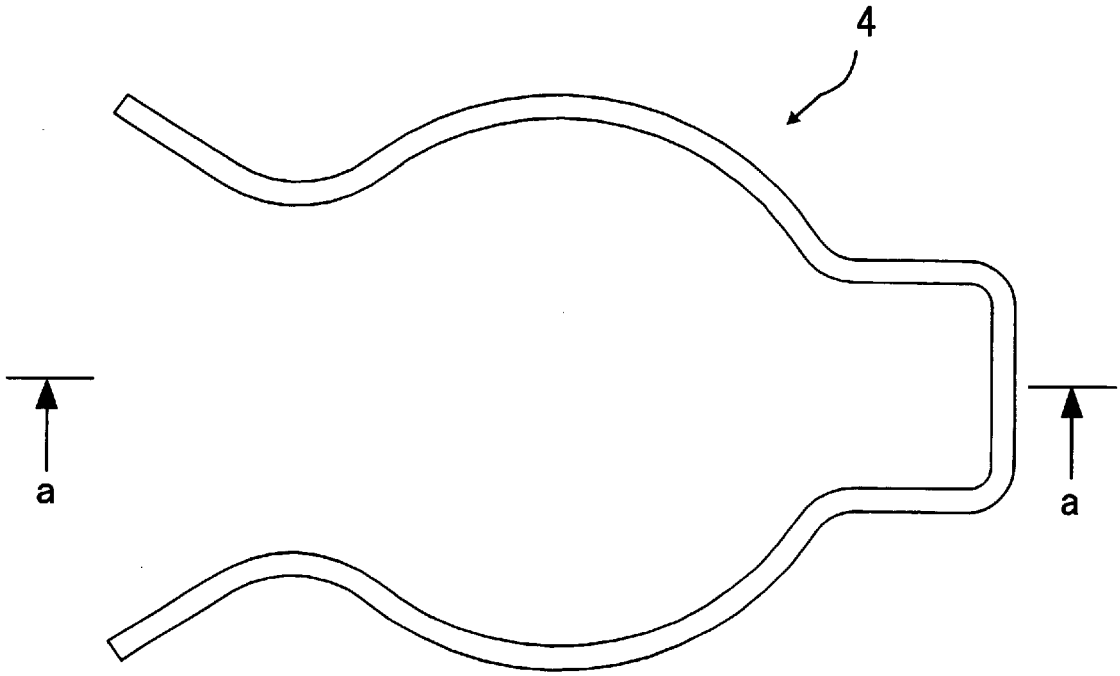
FIGS. 4(A), (B) show a clip, wherein (A) is a plan view of the clip and (B) is a sectional view taken along line a—a in (A).
Figure 4:
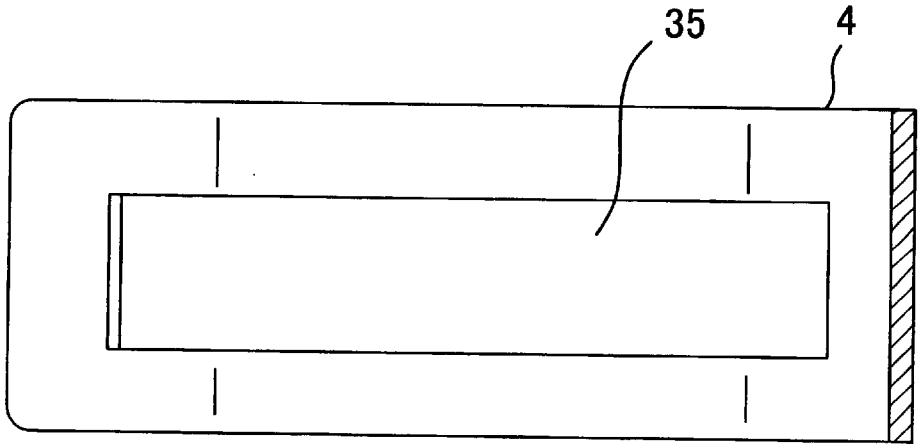
Figure 5:
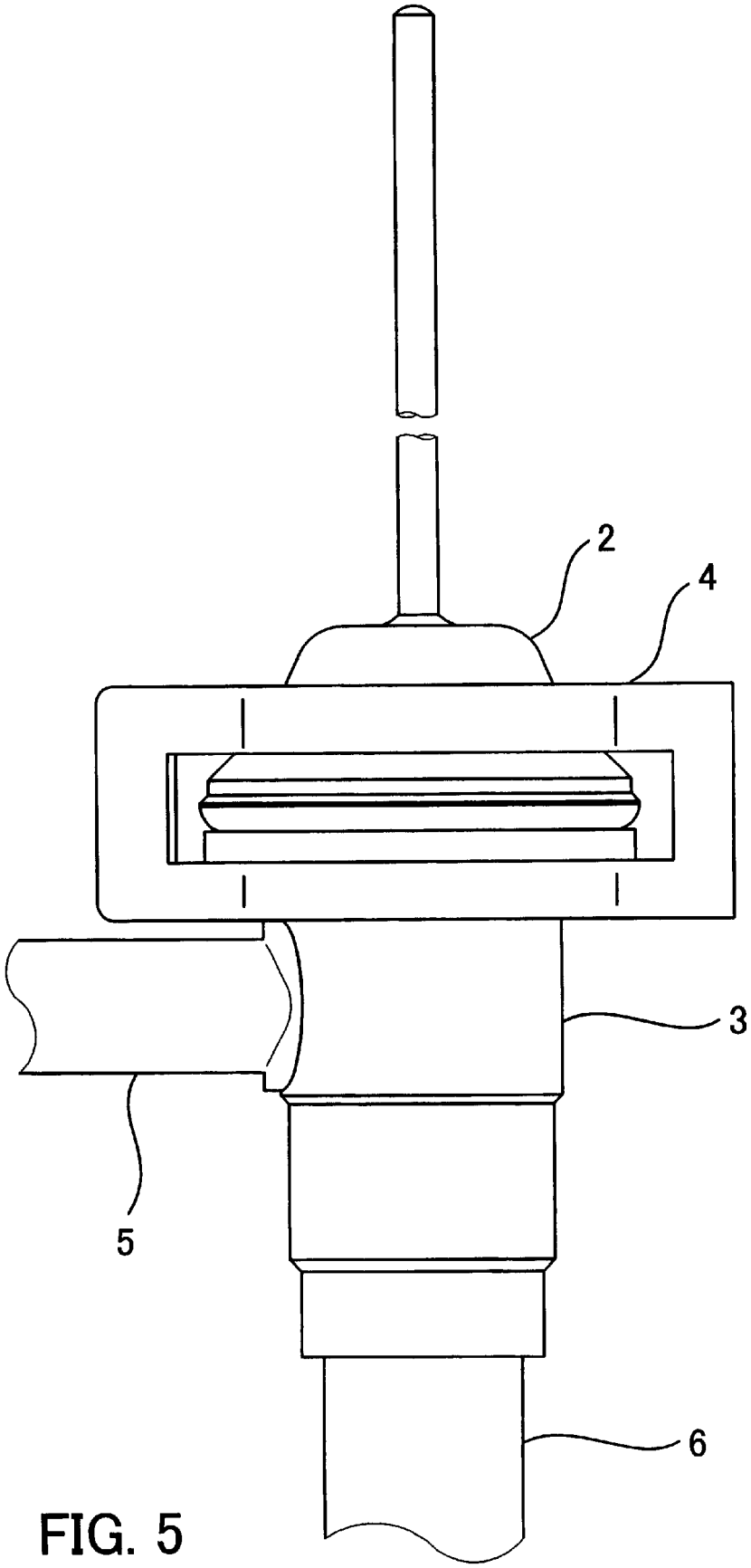
FIG. 5 is a side view of the expansion valve fitted with the clip.
Figure 6:
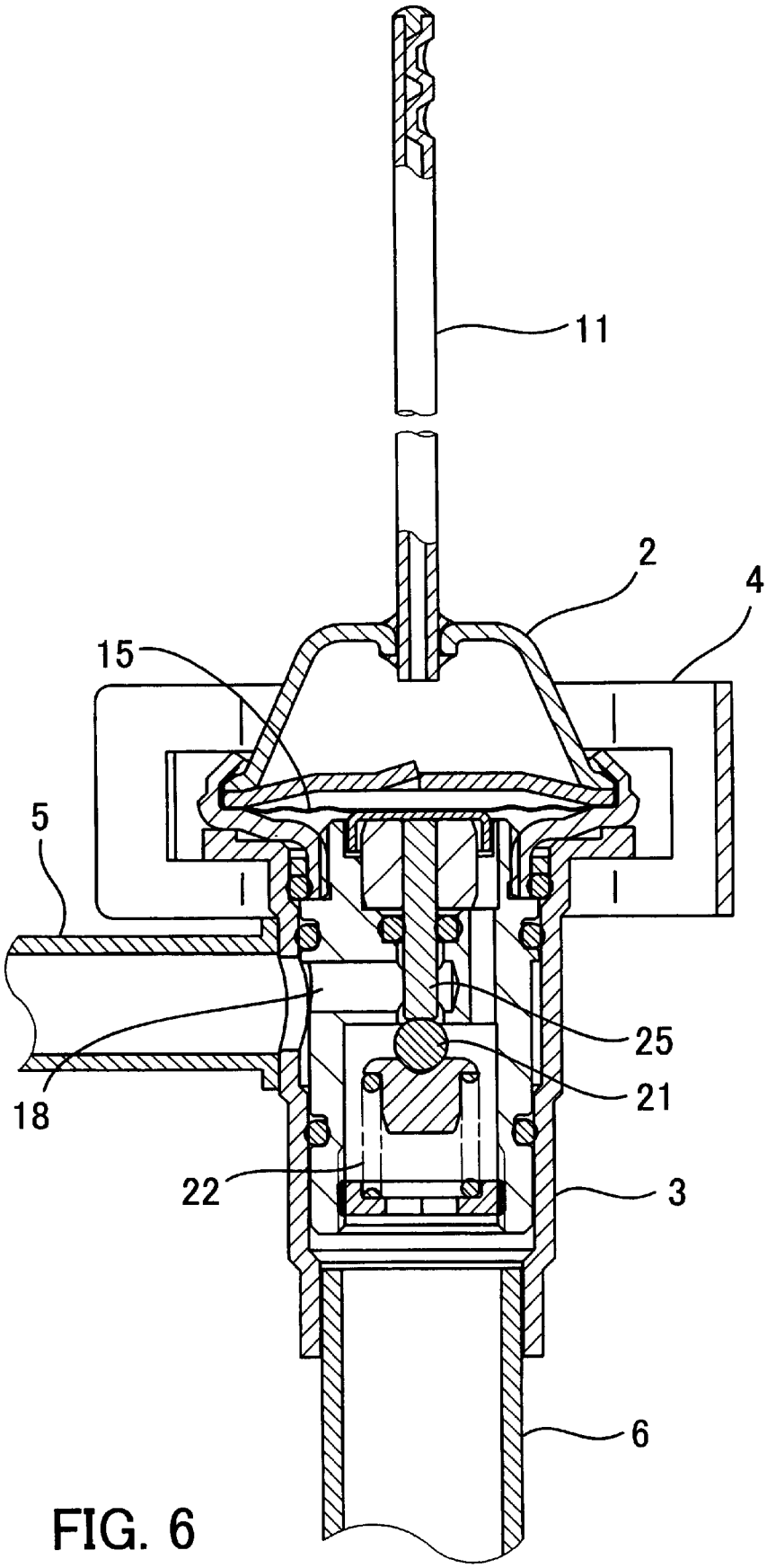
FIG. 6 is a longitudinal sectional view of the expansion valve fitted with the clip.

FIG. 4 illustrates the clip, wherein (A) is a plan view of the clip and (B) is a sectional view taken along line a—a in (A), FIG. 5 is a side view of the expansion valve fitted with the clip, and FIG. 6 is a longitudinal sectional view of the expansion valve fitted with the clip.

The clip 4 is made of a hard material having elasticity, for example, stainless steel, and is a generally U-shaped member, and an elongate opening 35 is cut in a central portion of each of arms forming the sides of the clip. After the expansion valve unit 2 is fitted into the valve casing 3, the distal ends of the arms are brought into contact with a junction where the temperature-sensitive chamber mount 16 of the expansion valve unit 2 is butted against the flange 34 of the valve casing 3 and the clip 4 is pushed sideways, whereby the peripheral edges of the temperature-sensitive chamber mount 16 and the flange 34 simultaneously fit into the elongate openings 35. Consequently, the expansion valve unit 2 and the valve casing 3 are fixed together, as shown in FIGS. 5 and 6, so that the expansion valve is assembled.

Figure 7:
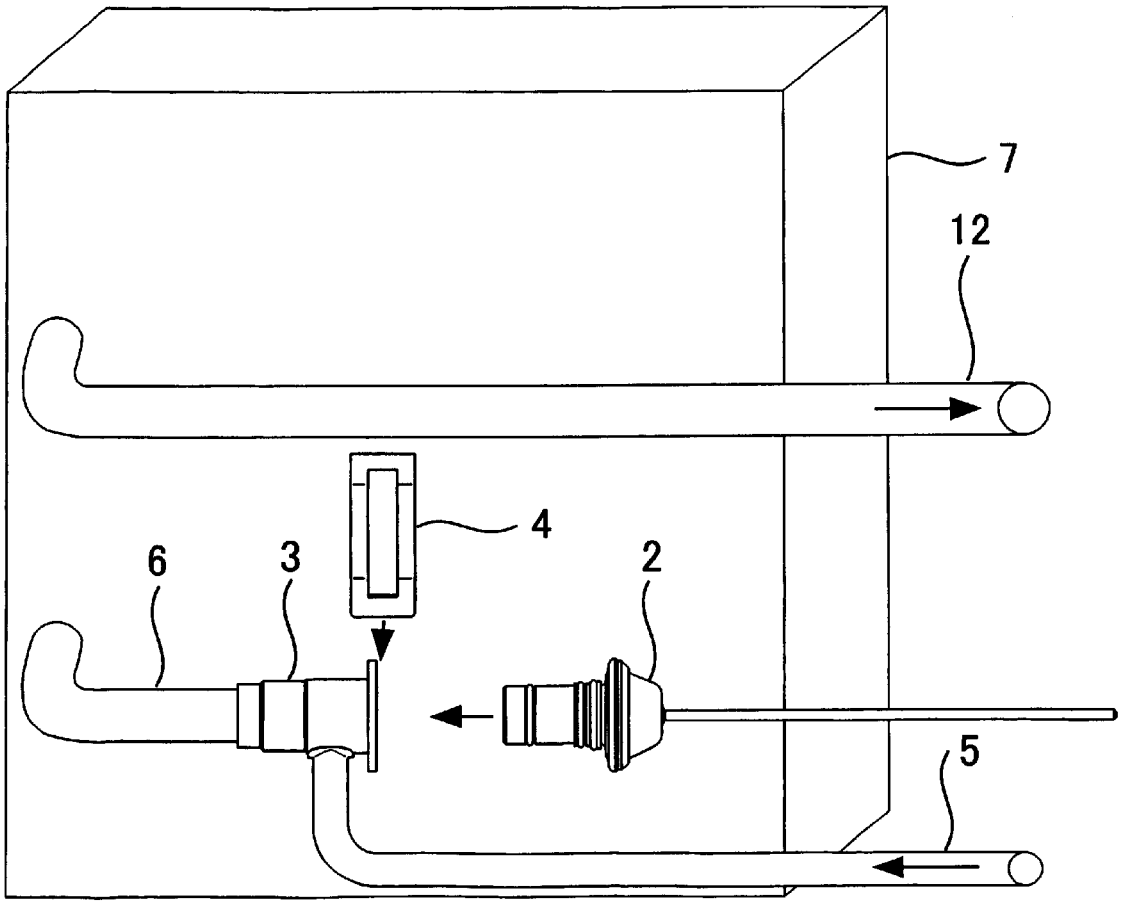
FIG. 7 is a side view showing a state before the expansion valve is assembled.
Figure 8:
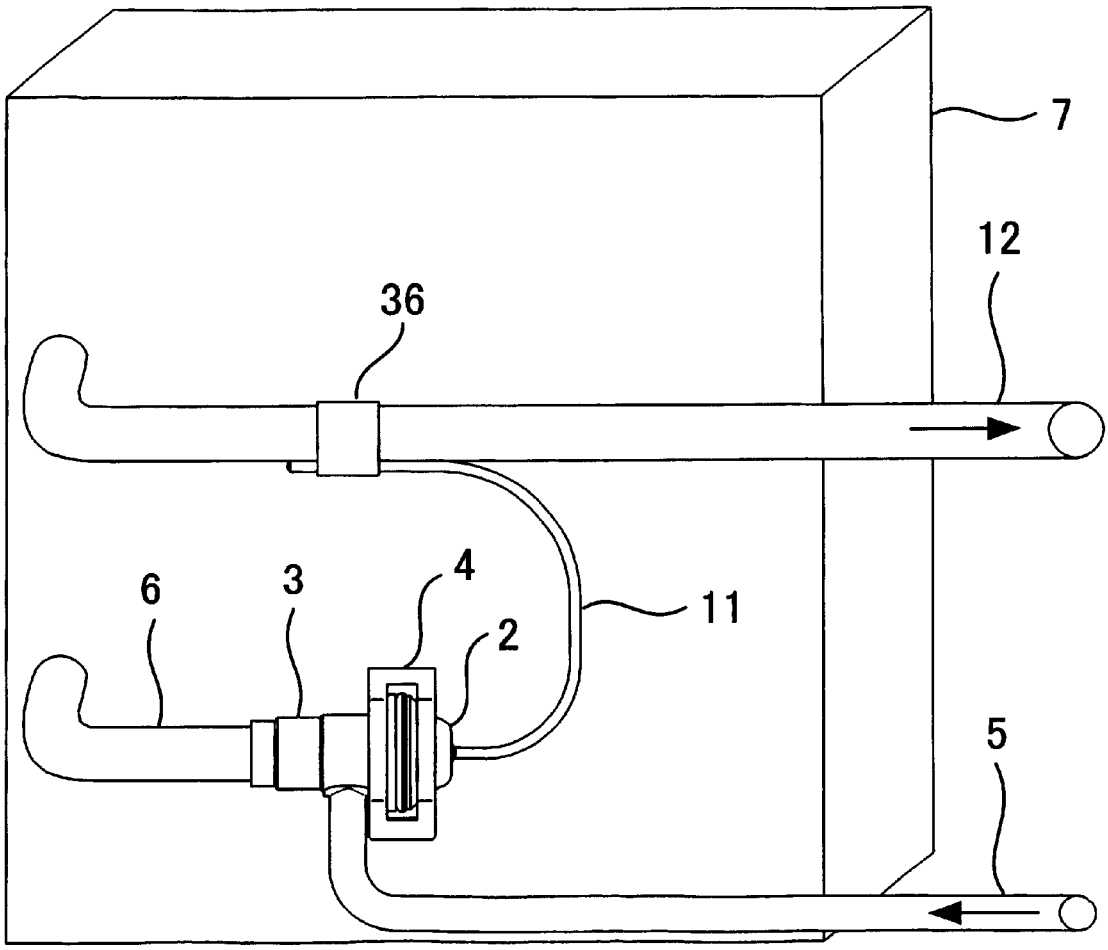
FIG. 8 is a side view showing a state after the expansion valve is assembled.

FIG. 7 is a side view showing a state before the expansion valve is assembled, and FIG. 8 is a side view showing a state after the expansion valve is assembled.

The expansion valve is assembled in the manner described below. Since the evaporator 7, the low-pressure refrigerant pipe 6, the valve casing 3 and the high-pressure refrigerant pipe 5 are formed integrally with each other, the integral structure is first placed in an automobile, the expansion valve unit 2 is inserted into the valve casing 3, and the clip 4 is fitted to fix the expansion valve unit 2 to the valve casing 3. Subsequently, the distal end portion of the temperature sensing cylinder 11 of the expansion valve unit 2 is brought into close contact with the outlet pipe 12 of the evaporator 7 and fixed thereto using a band 36.

When the expansion valve is assembled, therefore, fastening members such as nuts need not be used to connect the low-pressure and high-pressure refrigerant pipes 6 and 5, making it possible to reduce the assembling cost. Further, since the expansion valve unit 2 having a minimum function to serve as an expansion valve has only to be prepared, the cost of parts can be cut down, not to mention the fact that no fastening members are required.

Figure 9:
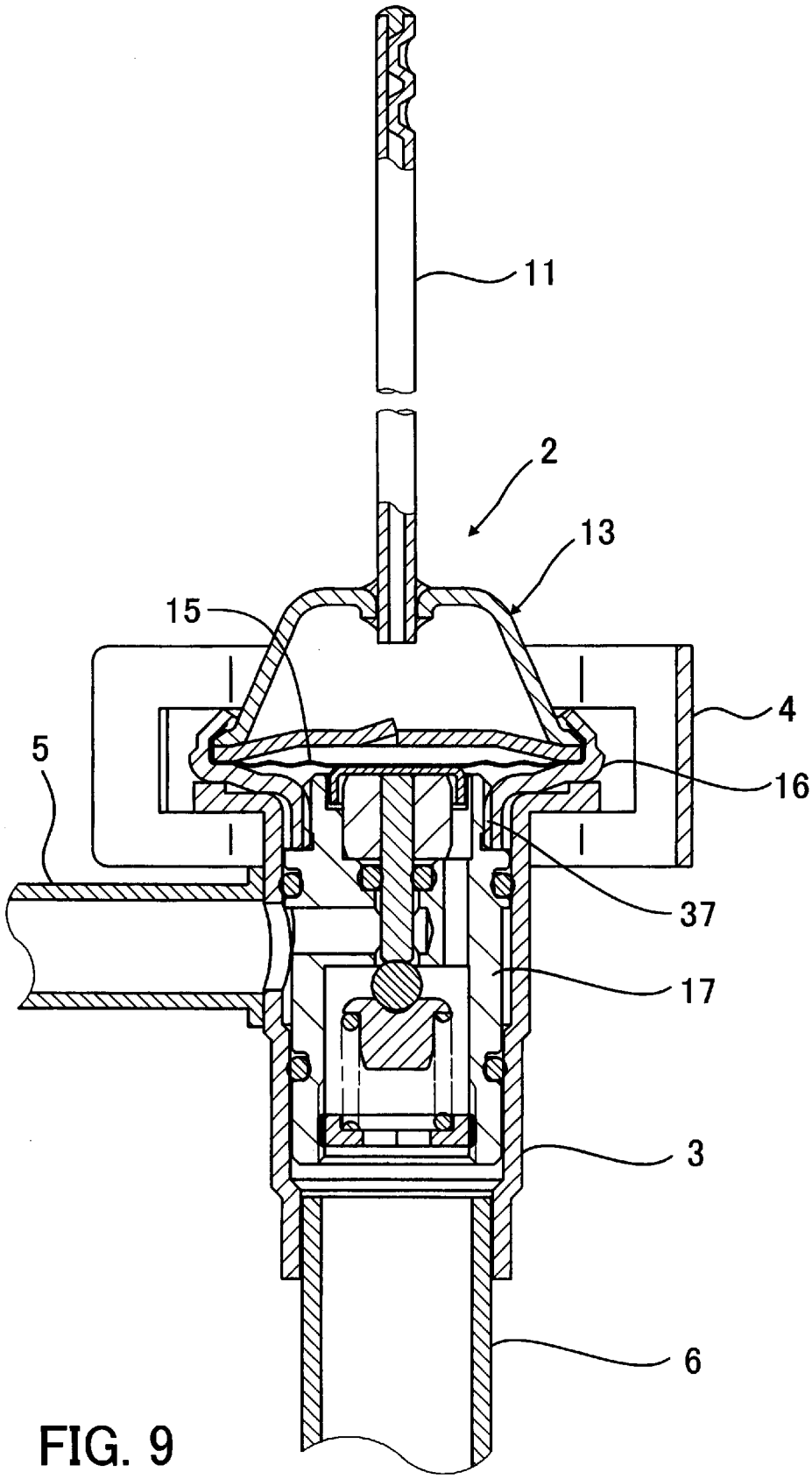
FIG. 9 is a longitudinal sectional view of an expansion valve according to a second embodiment of the present invention.

FIG. 9 is a longitudinal sectional view of an expansion valve according to a second embodiment of the present invention. In FIG. 9, identical reference numerals are used to denote elements identical with those appearing in FIGS. 2 and 6, and detailed description of such elements is omitted.

In the expansion valve of the second embodiment, the temperature-sensitive chamber mount 16 of the temperature-sensitive chamber 13 is screwed onto the body 17 with a sealant applied to threads 37 by means of which the elements 16 and 17 are fixed together. This prevents the space beneath the diaphragm 15 from communicating with the atmosphere through a gap between the threads 37. It is therefore unnecessary to use the O ring 32 and the backup ring 33 which are required in the expansion valve of the first embodiment.

The expansion valve is assembled by inserting the expansion valve unit 2 into the valve casing 3 and then fitting the clip 4, as in the expansion valve of the first embodiment.

Figure 10:
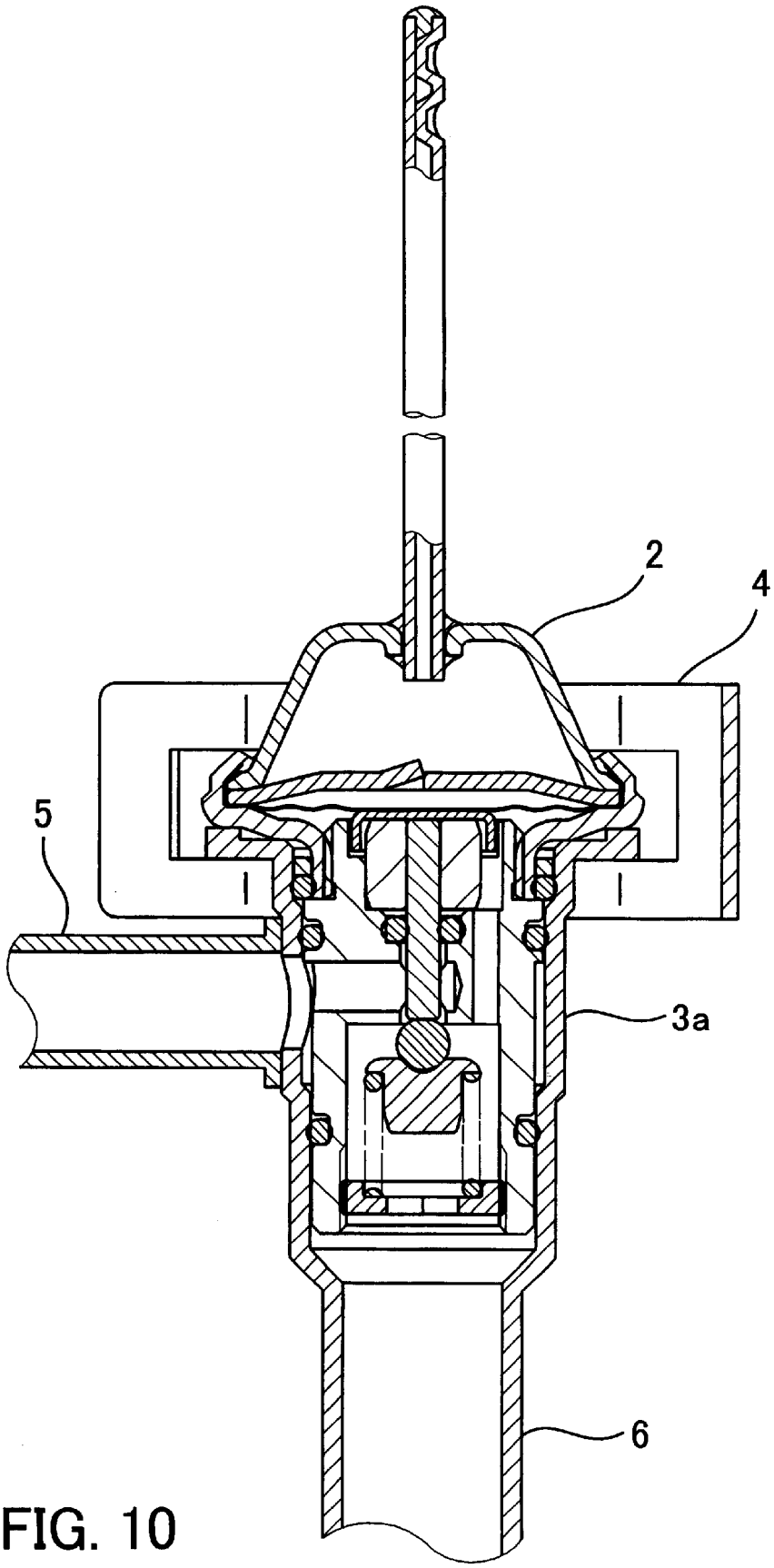
FIG. 10 is a longitudinal sectional view of an expansion valve according to a third embodiment of the present invention.

FIG. 10 is a longitudinal sectional view of an expansion valve according to a third embodiment of the present invention. In FIG. 10, identical reference numerals are used to denote elements identical with those appearing in FIGS. 2 and 6, and detailed description of such elements is omitted.

In the expansion valve of the third embodiment, the low-pressure refrigerant pipe 6 has its end portion enlarged in diameter to serve as a valve casing 3*a,* and the high-pressure refrigerant pipe 5 is joined integrally to the valve casing by aluminum welding.

Figure 11:
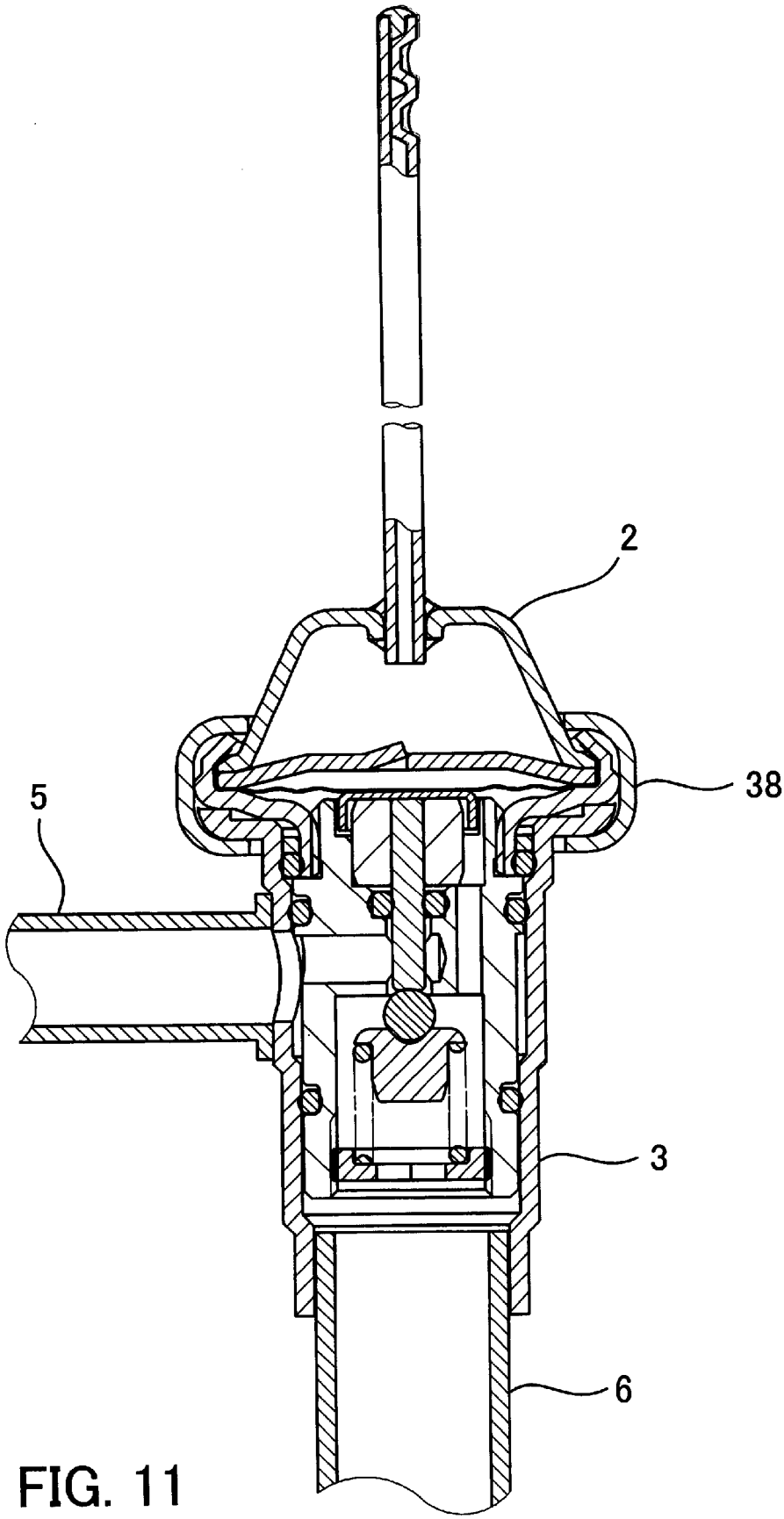
FIG. 11 is a longitudinal sectional view of an expansion valve according to a fourth embodiment of the present invention.
Figure 12:
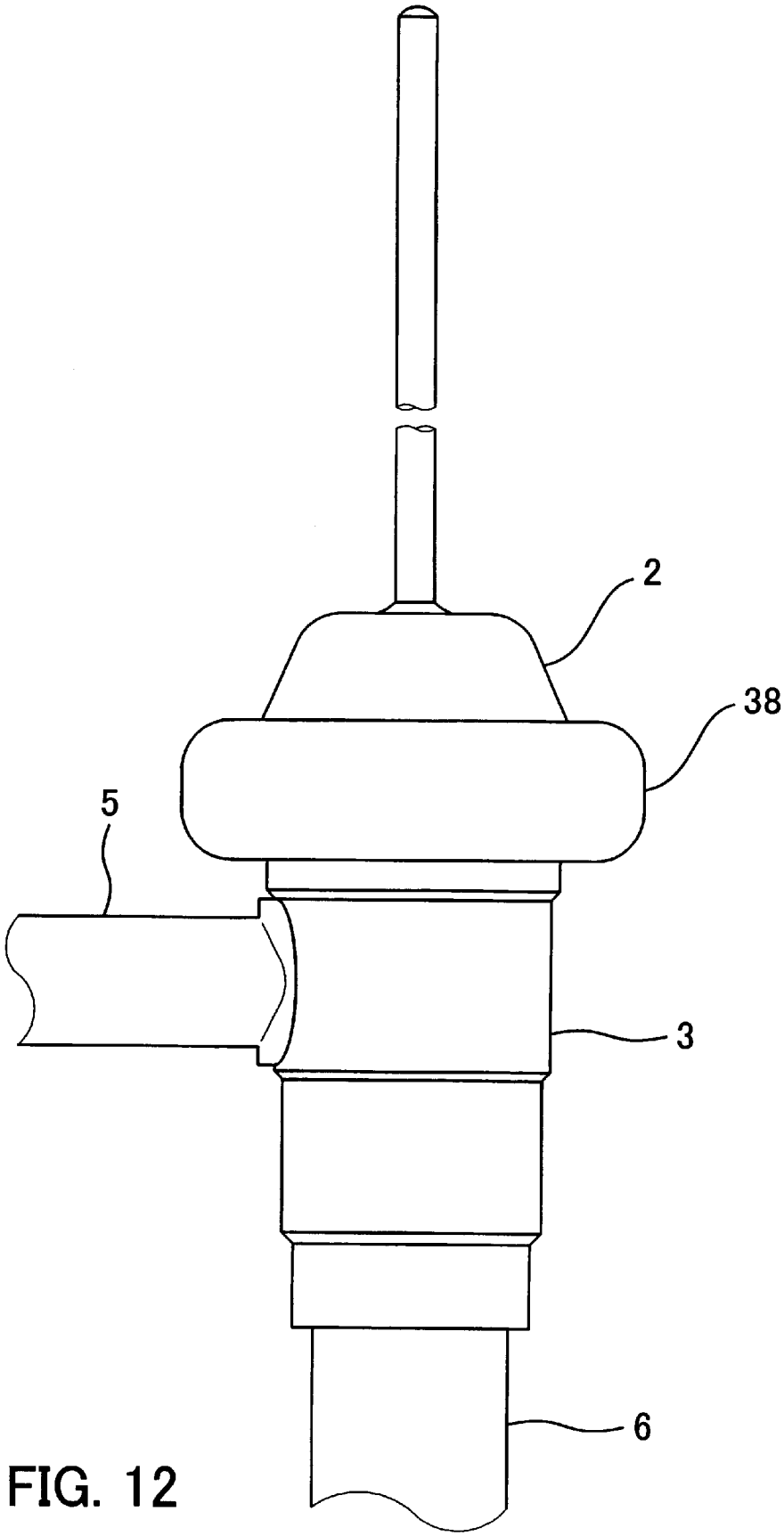
FIG. 12 is a side view showing an external appearance of the expansion valve according to the fourth embodiment of the present invention.

FIG. 11 is a longitudinal sectional view of an expansion valve according to a fourth embodiment of the present invention, and FIG. 12 is a side view showing an external appearance of the expansion valve of the fourth embodiment. In FIGS. 11 and 12, identical reference numerals are used to denote elements identical with those appearing in FIGS. 2 and 6, and detailed description of such elements is omitted.

In the expansion valve of the fourth embodiment, the valve casing 3 and the expansion valve unit 2 are fixed together by caulking upper and lower ends of a coupling 38. Specifically, after the expansion valve unit 2 is inserted into the valve casing 3, the coupling 38 is fitted and the upper and lower ends thereof are caulked.

Alternatively, the upper end of the coupling 38 may be narrowed in advance, and after the coupling 38 is fitted on the expansion valve unit 2 inserted into the valve casing 3, the lower end of the coupling 38 may be caulked to fix the elements 2 and 3 together.

Figure 13:
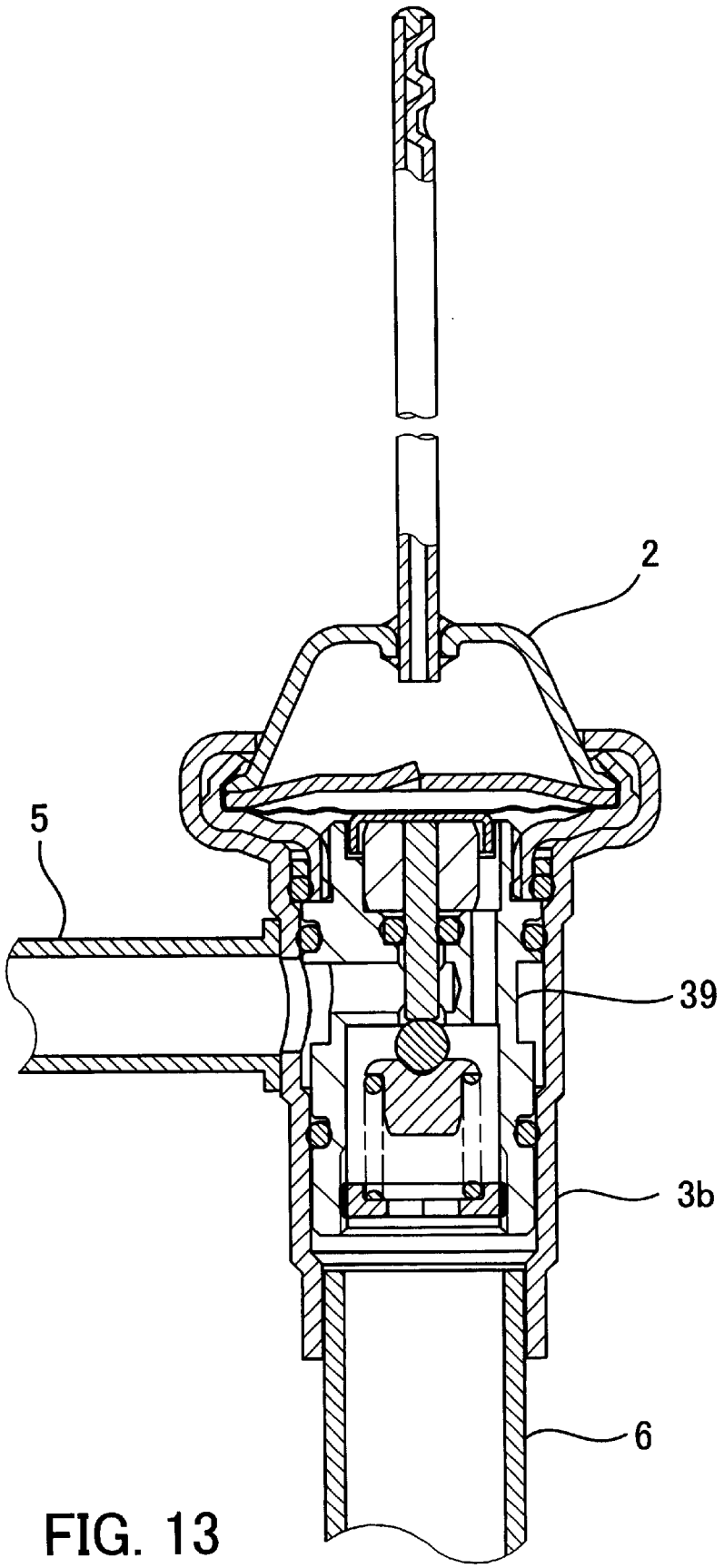
FIG. 13 is a longitudinal sectional view of an expansion valve according to a fifth embodiment of the present invention.

FIG. 13 is a longitudinal sectional view of an expansion valve according to a fifth embodiment of the present invention. In FIG. 13, identical reference numerals are used to denote elements identical with those appearing in FIGS. 2 and 6, and detailed description of such elements is omitted.

In the expansion valve of the fifth embodiment, a valve casing 3*b* has an extended end portion at the opening thereof, and after the expansion valve unit 2 is inserted into the valve casing 3*b*, the open end of the valve casing 3*b* is caulked to fix the expansion valve unit 2 to the valve casing 3*b*.

Also, the expansion valve unit 2 has a groove 39 formed on the outer peripheral surface of the body 17. Thus, when the expansion valve unit 2 is inserted into the valve casing 3*b*, a space is defined between the expansion valve unit and the valve casing 3*b*, and this space ensures smooth flow of the refrigerant.

Figure 14:
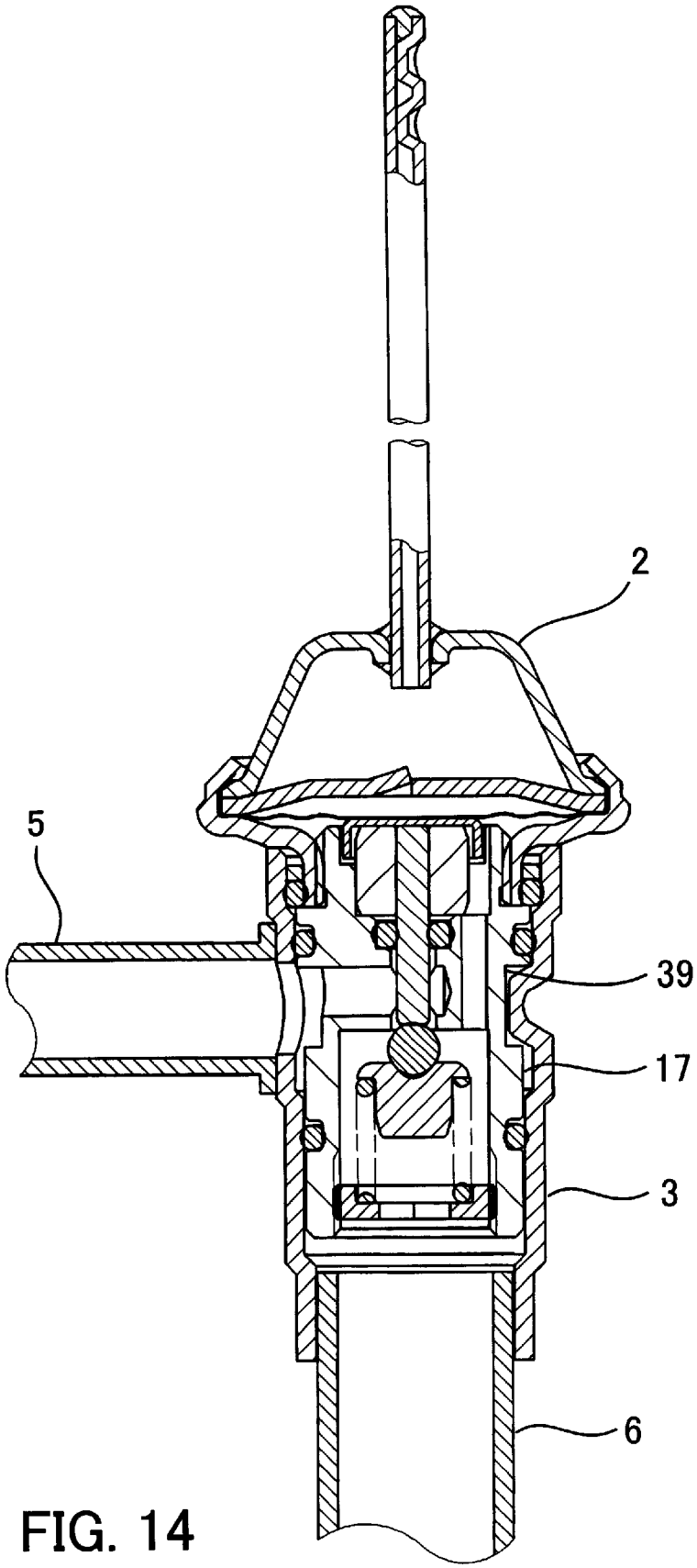
FIG. 14 is a longitudinal sectional view of an expansion valve according to a sixth embodiment of the present invention.

FIG. 14 is a longitudinal sectional view of an expansion valve according to a sixth embodiment of the present invention. In FIG. 14, identical reference numerals are used to denote elements identical with those appearing in FIGS. 2 and 6, and detailed description of such elements is omitted.

In the expansion valve of the sixth embodiment, the groove 39 is formed on the outer peripheral surface of the body 17 of the expansion valve unit 2, and after the expansion valve unit 2 is inserted into the valve casing 3, a portion of the valve casing 3 corresponding in position to the groove 39 is caulked to be pressed into the groove 39 so that the expansion valve unit 2 may not be detached from the valve casing 3. The valve casing may be caulked over a circumferential region except for the joint where the high-pressure refrigerant pipe 5 is joined, or at one or more spots.

Figure 15:
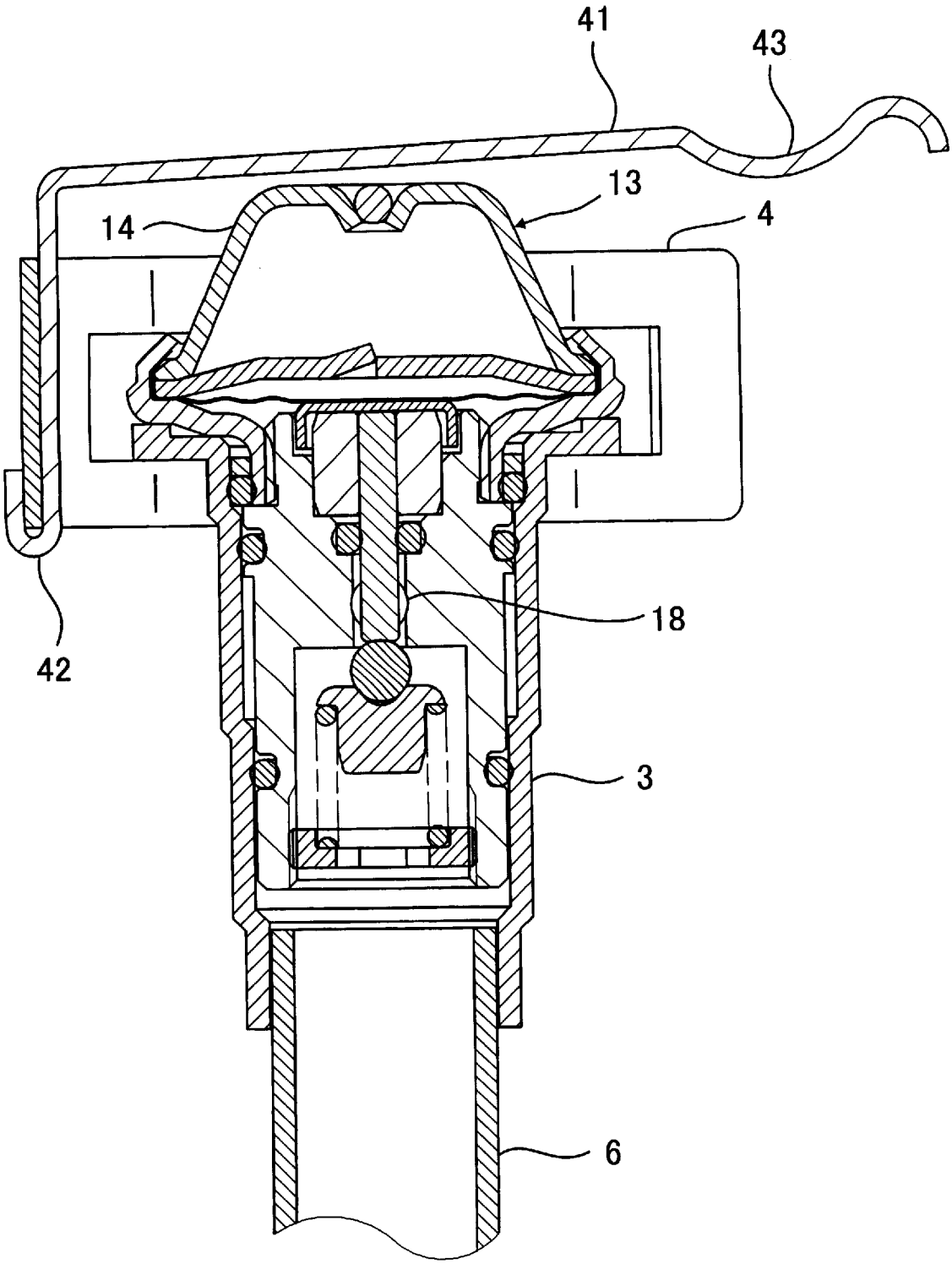
FIG. 15 is a longitudinal sectional view of an expansion valve according to a seventh embodiment of the present invention.

FIG. 15 is a longitudinal sectional view of an expansion valve according to a seventh embodiment of the present invention. In FIG. 15, identical reference numerals are used to denote elements identical with those appearing in FIG. 6, and detailed description of such elements is omitted.

In the expansion valve of the seventh embodiment, the temperature of the refrigerant in the outlet pipe 12 of the evaporator 7 is detected not by the temperature sensing cylinder 11, but through the agency of heat conduction by a heat conducting member 41.

The heat conducting member 41 is made of an alloy having elasticity, such as a copper alloy or a beryllium alloy, and has an engaging portion 42 at one end thereof for engagement with the clip 4 and a pipe receiving portion 43 at the other end thereof, the pipe receiving portion being arcuately curved in conformity with the external form of the outlet pipe 12 of the evaporator 7. The heat conducting member 41 is configured such that when the clip 4 is attached, the area of contact between the heat conducting member and the temperature-sensitive chamber 13 of the expansion valve unit 2 is large.

Specifically, the heat conducting member 41 is formed like a plate, while the housing 14 constituting the temperature-sensitive chamber 13 of the expansion valve unit 2 has a flat top face. The housing 14 has a hole formed in the center of the top face thereof to permit gas to be introduced therein, and the hole is sealed with a ball in a gaseous atmosphere by resistance welding.

Figure 16:
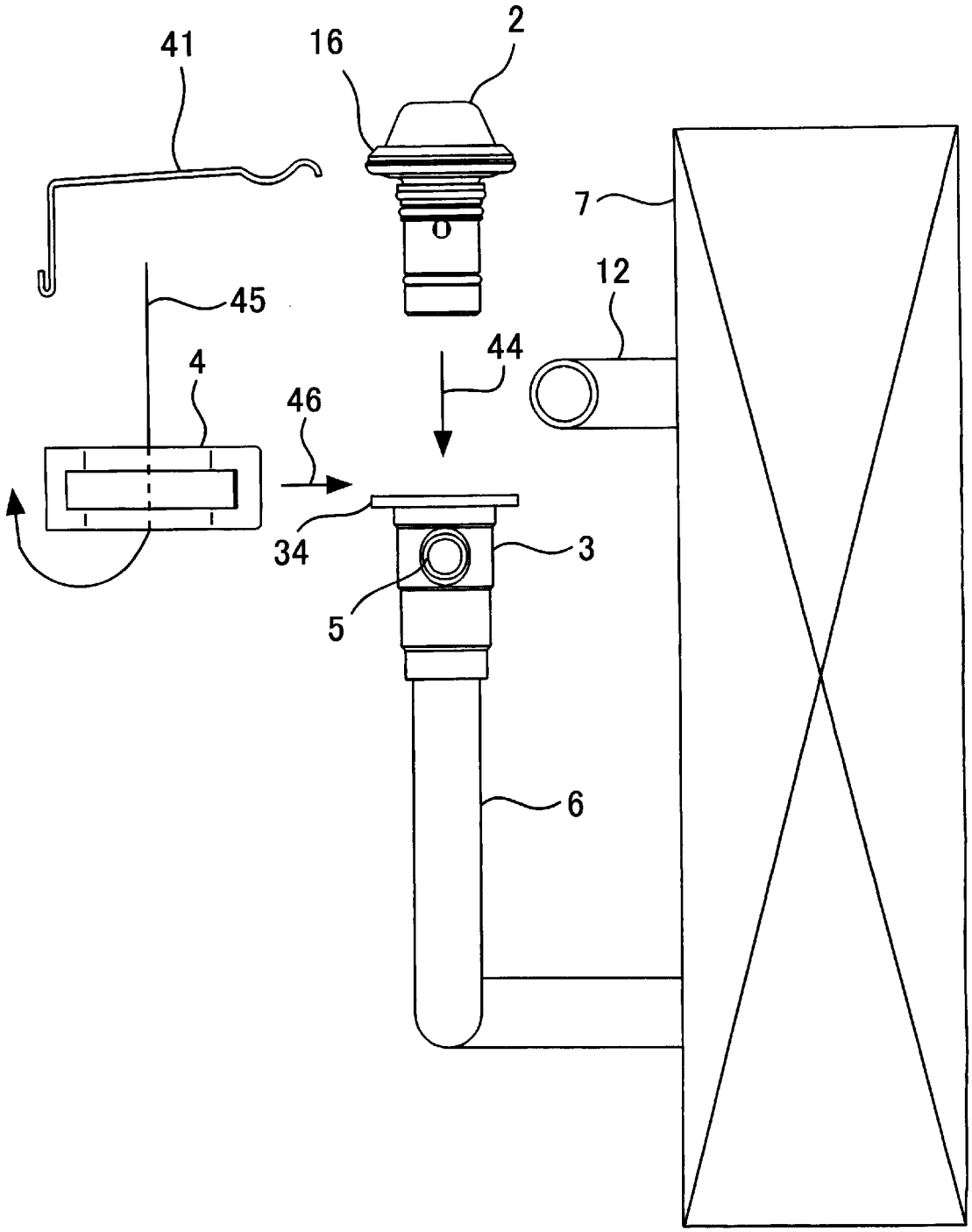
FIG. 16 is an exploded view showing a state before the expansion valve is assembled.
Figure 17:
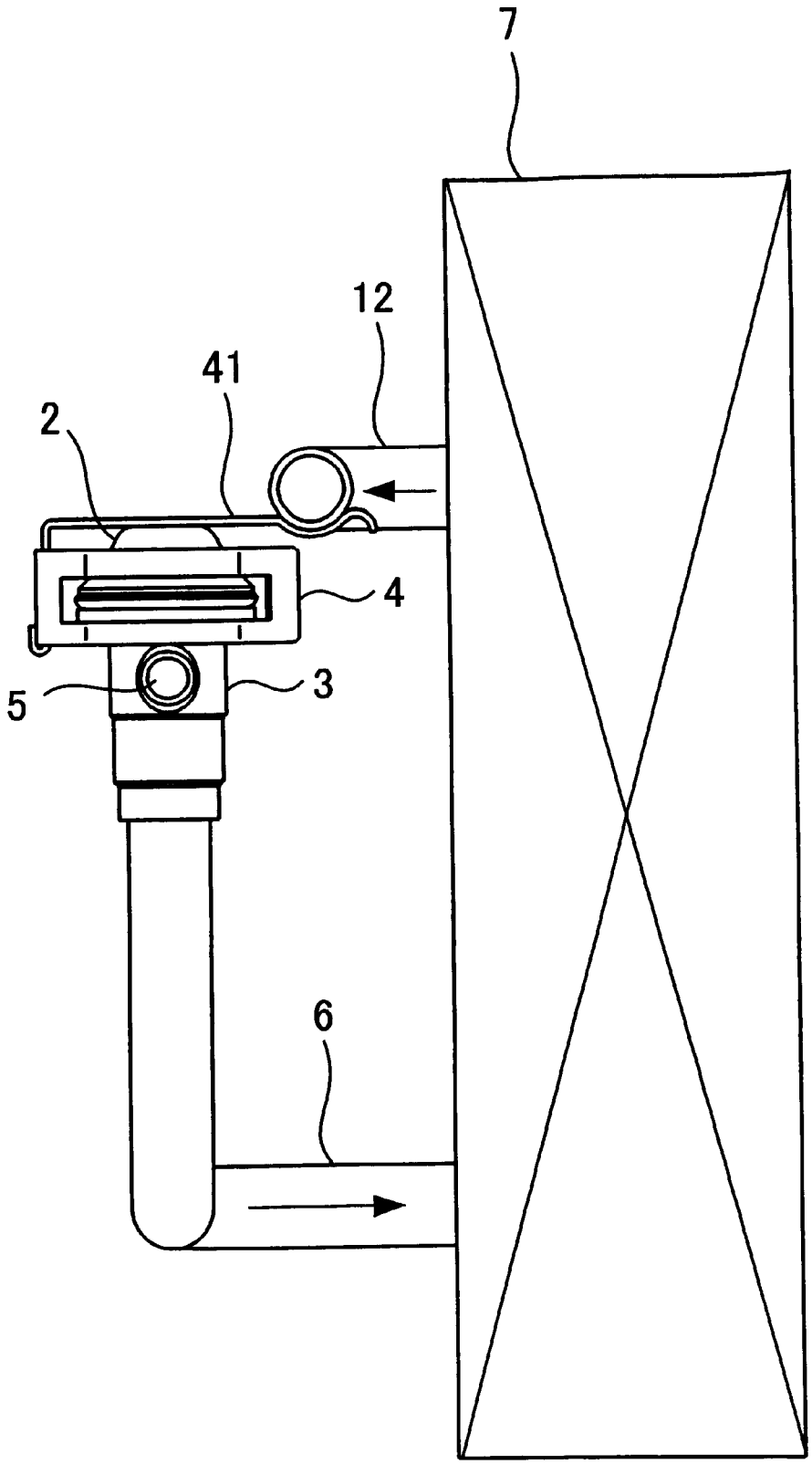
FIG. 17 is a side view of an evaporator connected with the assembled expansion valve.
Figure 18:
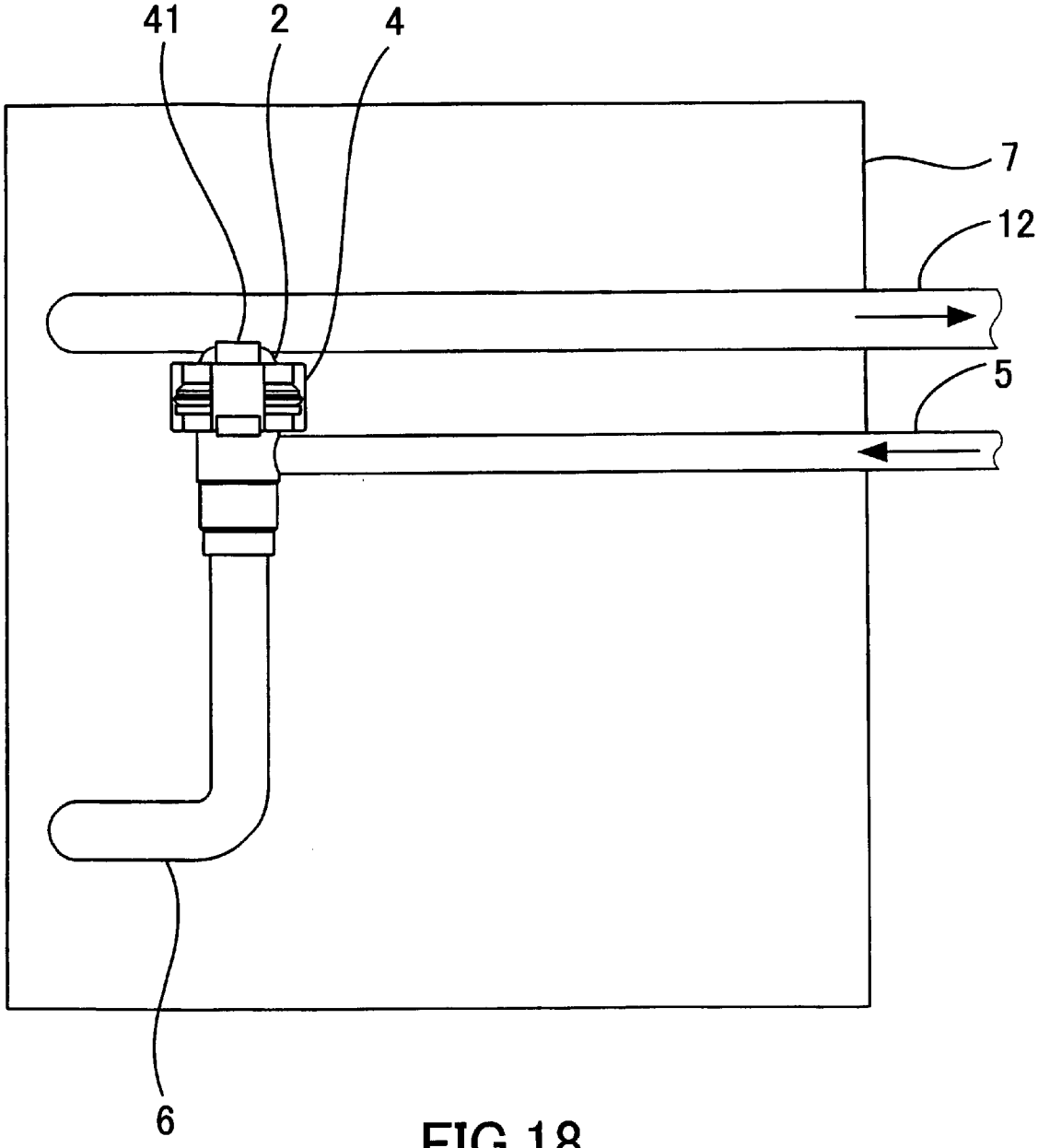
FIG. 18 is a front view of the evaporator connected with the assembled expansion valve.

FIG. 16 is an exploded view showing a state before the expansion valve is assembled, FIG. 17 is a side view of the evaporator connected with the assembled expansion valve, and FIG. 18 is a front view of the evaporator connected with the assembled expansion valve.

The manner of assembling the expansion valve of the seventh embodiment will be now described. The evaporator 7 is formed integrally with the valve casing 3, the high-pressure and low-pressure refrigerant pipes 5 and 6, and the outlet pipe 12. The valve casing 3 is located remoter from the front face of the evaporator 7 than the outlet pipe 12 extending parallel to the front face.

To assemble the expansion valve, first, the expansion valve unit 2 is inserted into the valve casing 3, as indicated by arrow 44, then the heat conducting member 41 is engaged with the clip 4, as indicated by arrow 45, and finally the clip 4 is pushed in, as indicated by arrow 46, to fasten together the temperature-sensitive chamber mount 16 of the inserted expansion valve unit 2 and the flange 34 of the valve casing 3 in a manner such that the distal end portion of the heat conducting member 41 is in contact with the underside of the outlet pipe 12. Thus, when the temperature-sensitive chamber mount 16 of the expansion valve unit 2 and the flange 34 of the valve casing 3 are fixed together by the clip 4, the pipe receiving portion 43 of the heat conducting member 41 receives the outlet pipe 12, as best shown in FIG. 17. Since, in this case, the pipe receiving portion 43 of the heat conducting member 41 is pushed down, as viewed in the figure, the heat conducting member 41 is pressed against the top face of the expansion valve unit 2, whereby the temperature of the refrigerant flowing through the outlet pipe 12 is transmitted effectively to the temperature-sensitive chamber 13 via the pipe receiving portion 43.

Figure 19:
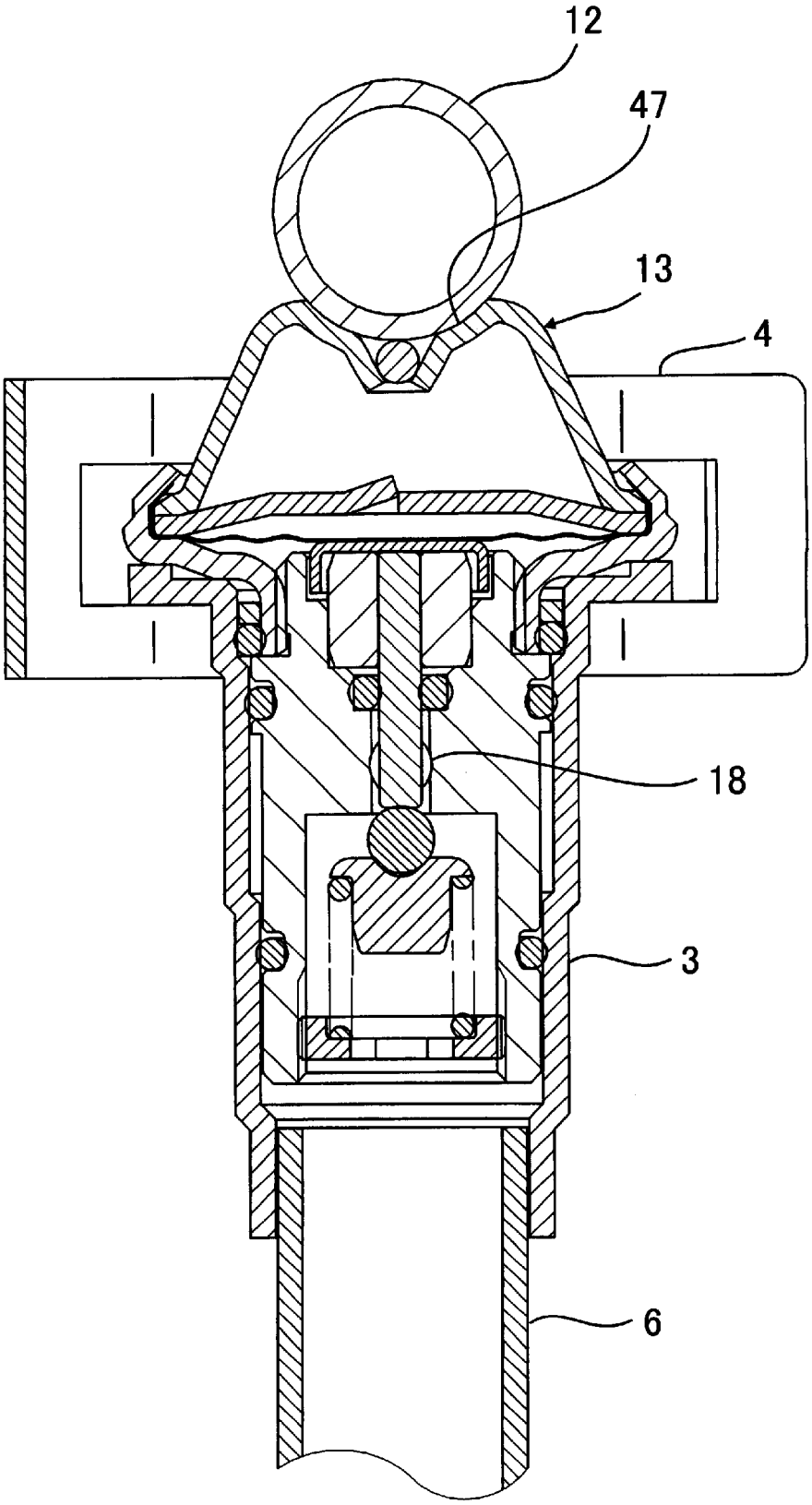
FIG. 19 is a longitudinal sectional view of an expansion valve according to an eighth embodiment of the present invention.

FIG. 19 is a longitudinal sectional view of an expansion valve according to an eighth embodiment of the present invention. In FIG. 19, identical reference numerals are used to denote elements identical with those appearing in FIG. 6, and detailed description of such elements is omitted.

In the expansion valve of the eighth embodiment, the temperature of the refrigerant in the outlet pipe 12 of the evaporator 7 is detected not by the temperature sensing cylinder 11 or the heat conducting member 41, but by means of heat conducted directly from the outlet pipe 12.

The temperature-sensitive chamber 13 of the expansion valve unit 2 has a pipe receiving portion 47 formed in the top face thereof as a recess matching the external form of the outlet pipe 12 of the evaporator 7. The outlet pipe 12 is located directly on the pipe receiving portion 47 such that the outlet pipe 12 and the temperature-sensitive chamber 13 directly contact with each other, whereby the temperature-sensitive chamber 13 can directly detect the temperature of the refrigerant flowing through the outlet pipe 12.

Figure 20:
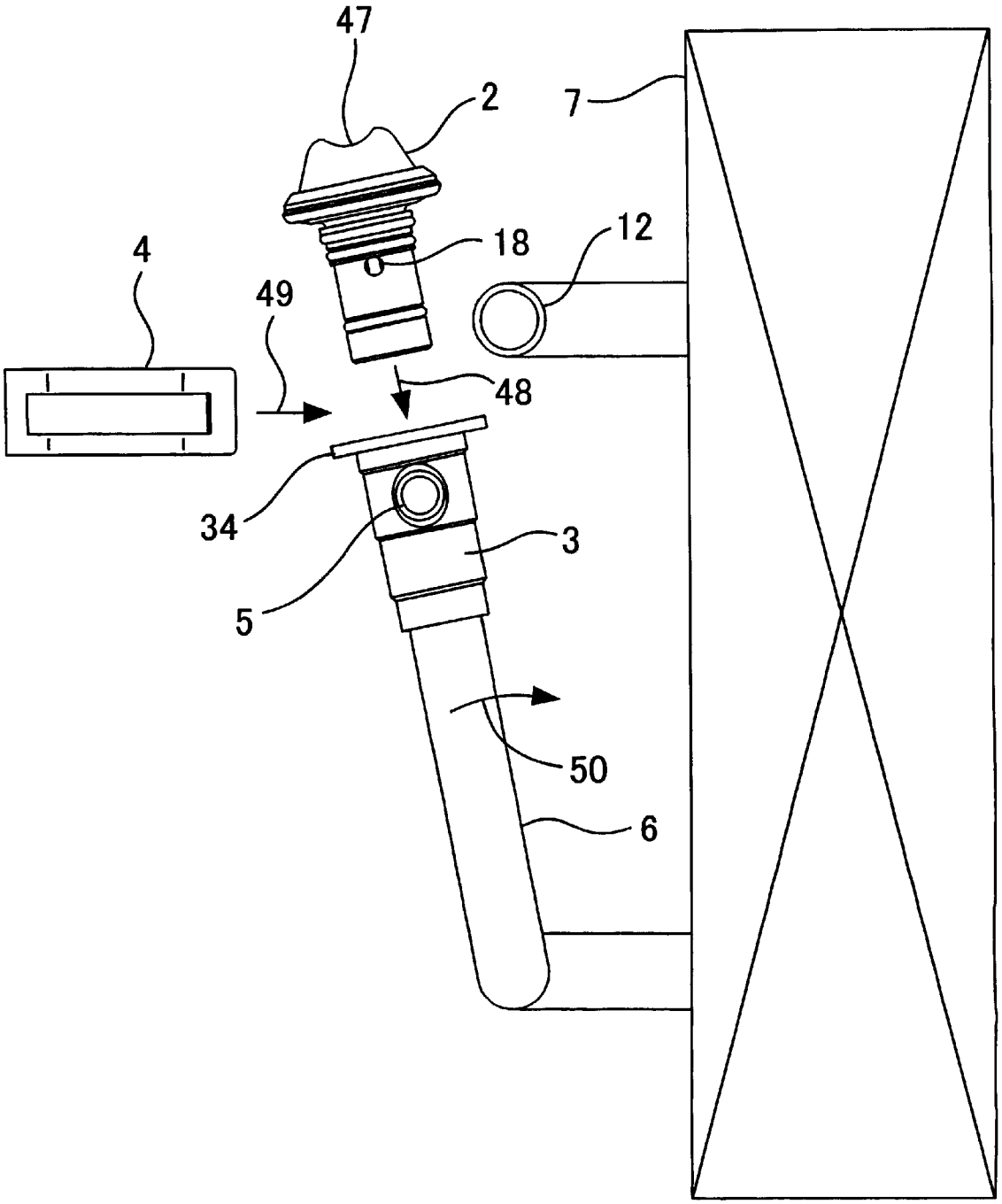
FIG. 20 is an exploded view showing a state before the expansion valve is assembled.
Figure 21:
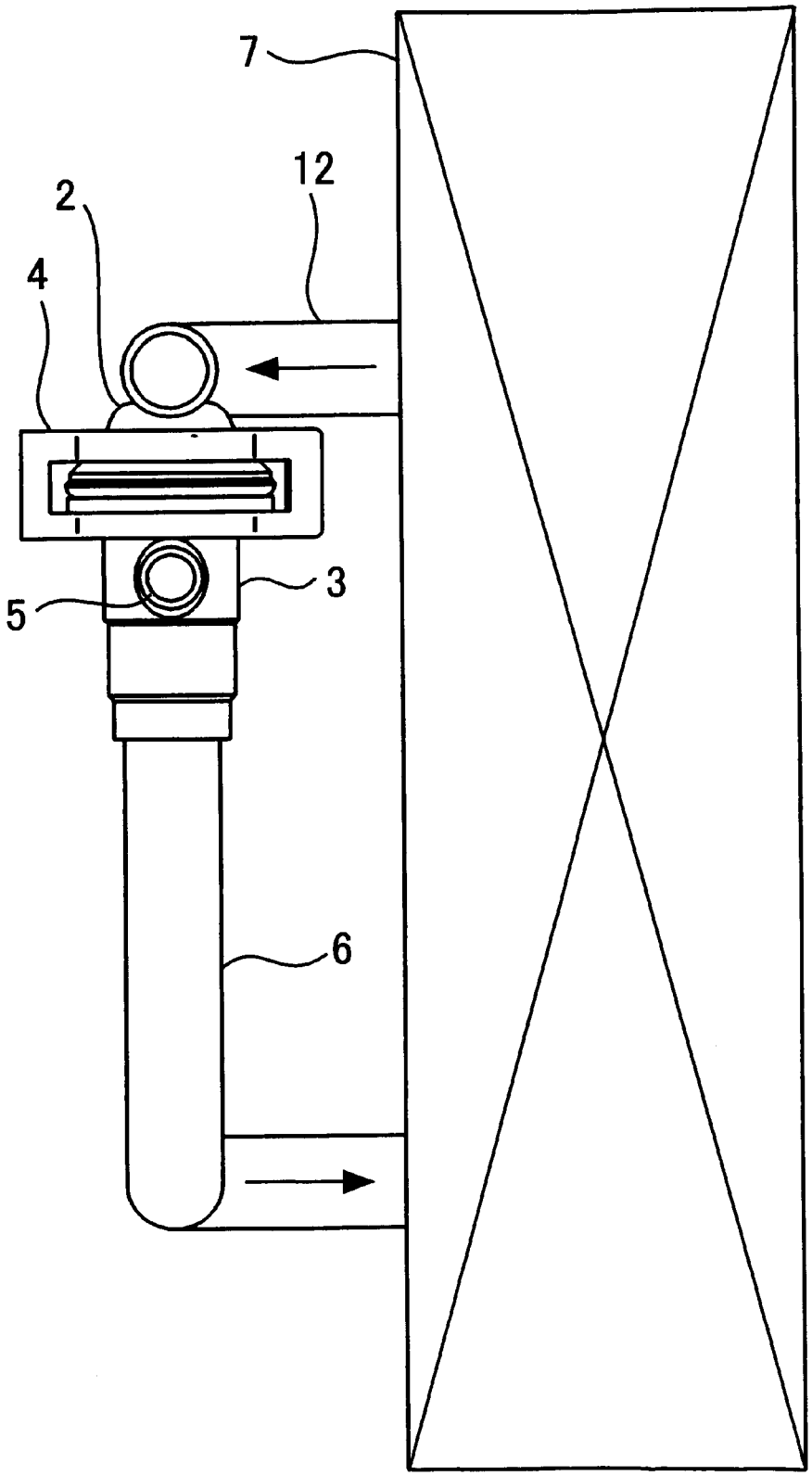
FIG. 21 is a side view of the evaporator connected with the assembled expansion valve.
Figure 22:
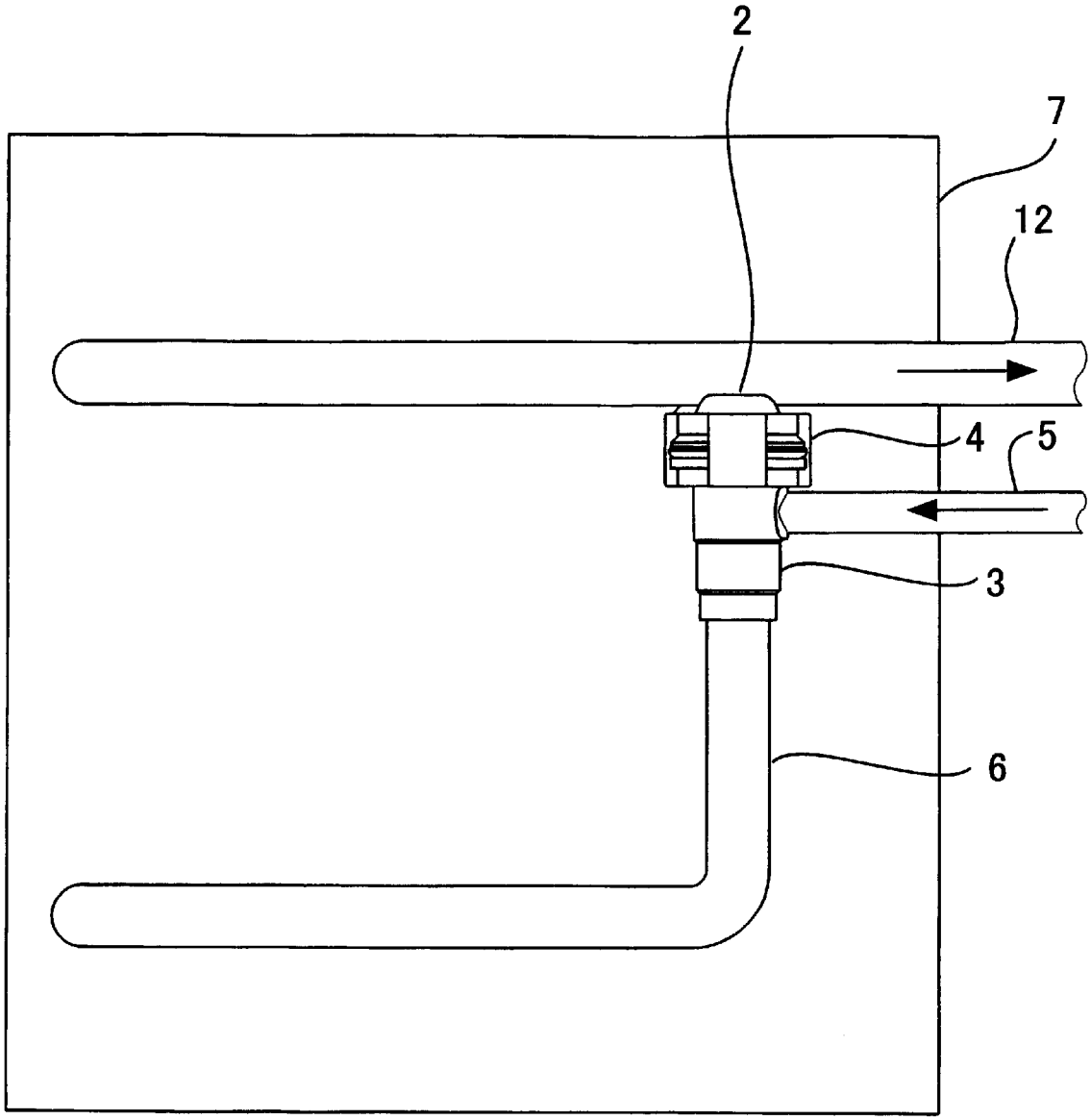
FIG. 22 is a front view of the evaporator connected with the assembled expansion valve.

FIG. 20 is an exploded view showing a state before the expansion valve is assembled, FIG. 21 is a side view of the evaporator connected with the assembled expansion valve, and FIG. 22 is a front view of the evaporator connected with the assembled expansion valve.

The manner of assembling the expansion valve of the eighth embodiment will be now described. The evaporator 7 is formed integrally with the valve casing 3, the high-pressure and low-pressure refrigerant pipes 5 and 6, and the outlet pipe 12. Portions of the low-pressure refrigerant pipe 6 and the outlet pipe 12 extending parallel to the front face of the evaporator 7 are located at an equal distance from the front face, while a portion of the low-pressure refrigerant pipe 6 joined integrally with the valve casing 3 in alignment therewith is tilted outward in a direction away from the front face of the evaporator 7.

To assemble the expansion valve, first, the expansion valve unit 2 is inserted into the valve casing 3, as indicated by arrow 48. In this case, the expansion valve unit 2 is inserted into the valve casing 3 in a manner such that the high-pressure refrigerant passage 18 in the body 17 is aligned with the high-pressure refrigerant pipe 5 and that the pipe receiving portion 47 of the temperature-sensitive chamber 13 is orientated in the same direction as the outlet pipe 12. Subsequently, the clip 4 is attached, as indicated by arrow 49, to fasten together the temperature-sensitive chamber mount 16 of the inserted expansion valve unit 2 and the flange 34 of the valve casing 3, and finally the tilted portion of the low-pressure refrigerant pipe 6 is raised to an upright position, as indicated by arrow 50, so as to be parallel with the front face of the evaporator 7. At this time, the outlet pipe 12 passes over the inclined surface of the housing 14 of the temperature-sensitive chamber 13 and fits in the recessed pipe receiving portion 47.

Consequently, the temperature-sensitive chamber 13 receives a load on contact with the outlet pipe 12 and thus is held in urging contact therewith, so that the temperature of the refrigerant flowing through the outlet pipe 12 is transmitted directly to the temperature-sensitive chamber 13.

Figure 23:
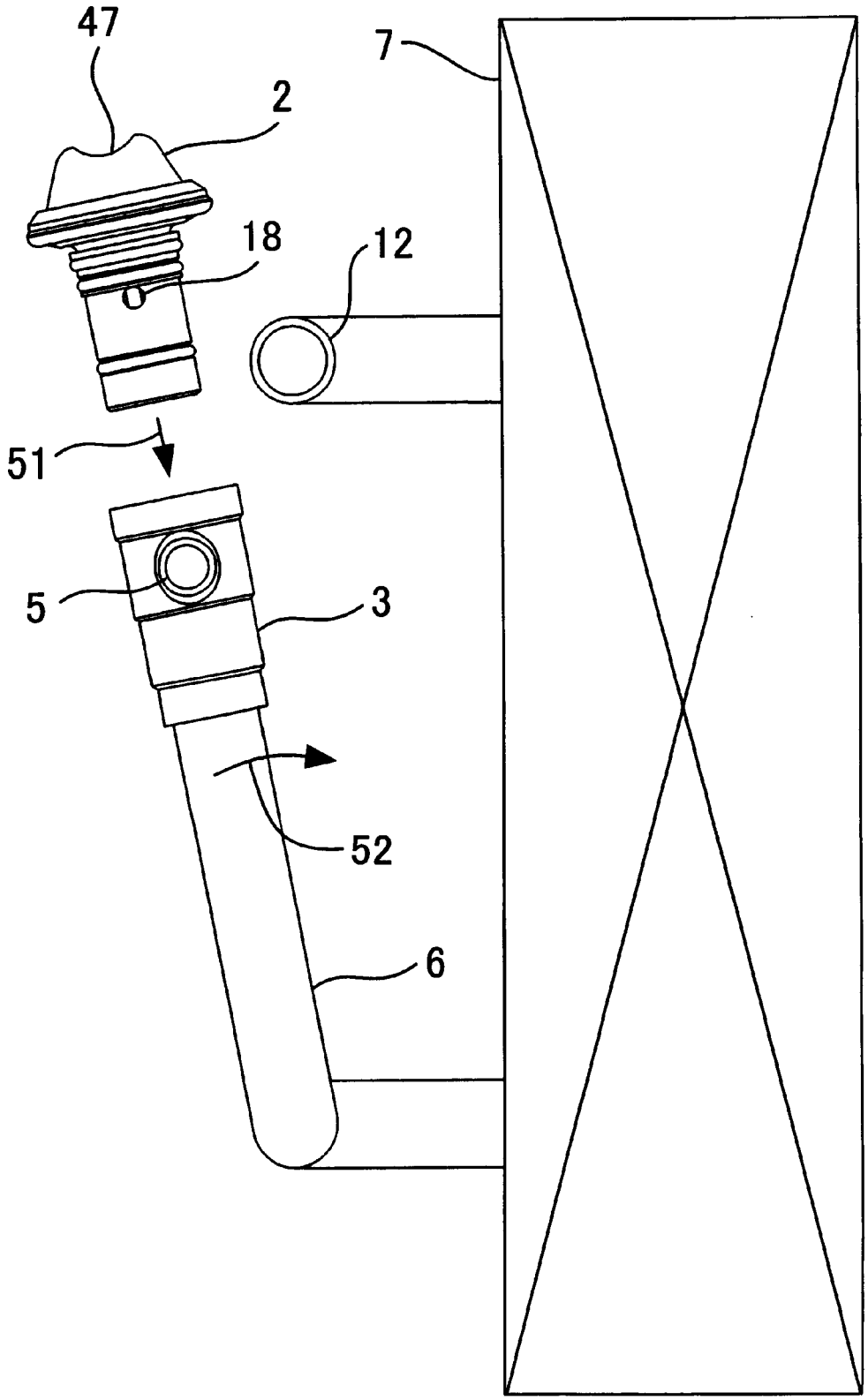
FIG. 23 is an exploded view showing a state before an expansion valve according to a ninth embodiment of the present invention is assembled.
Figure 24:
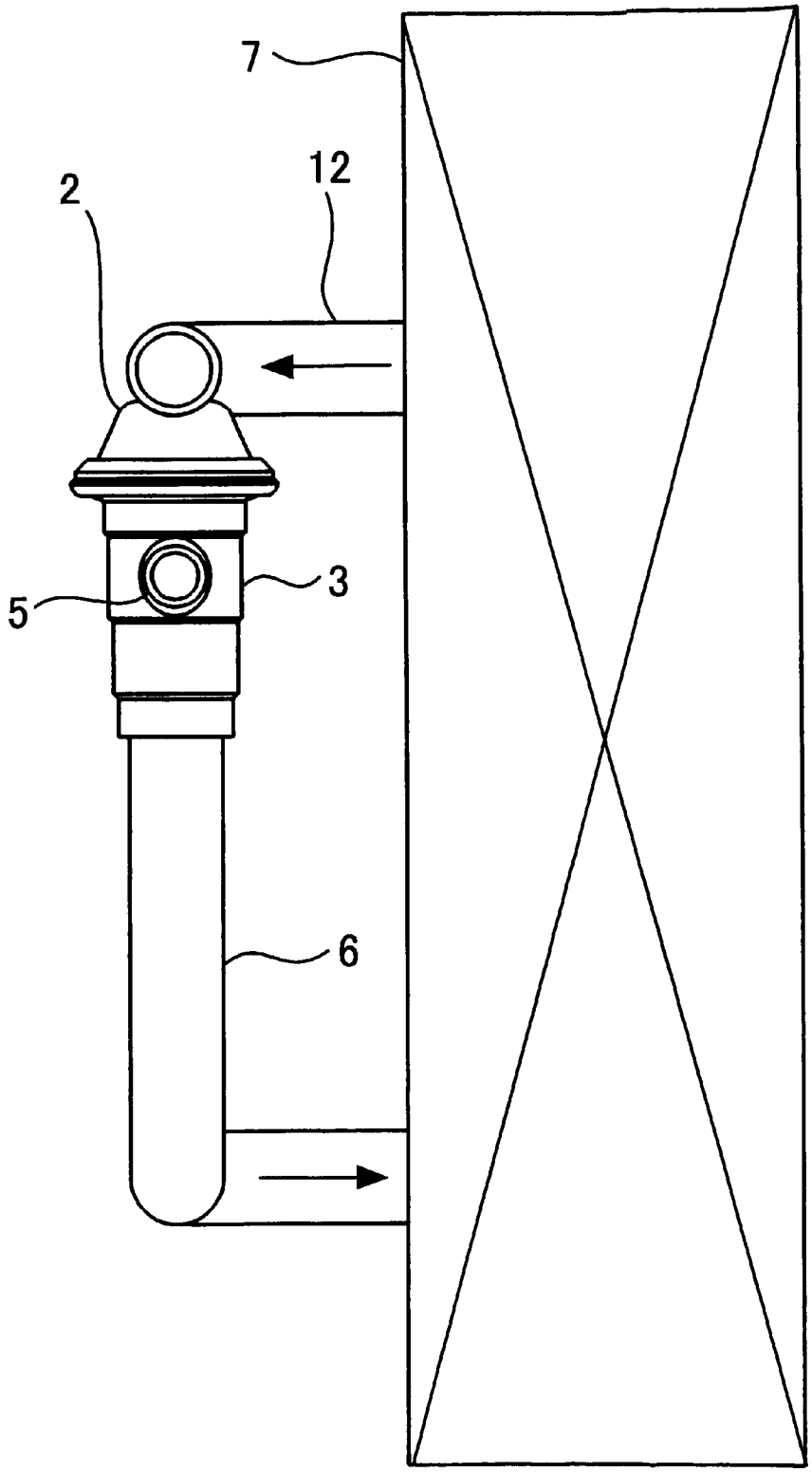
FIG. 24 is a side view of the evaporator connected with the assembled expansion valve.
Figure 25:
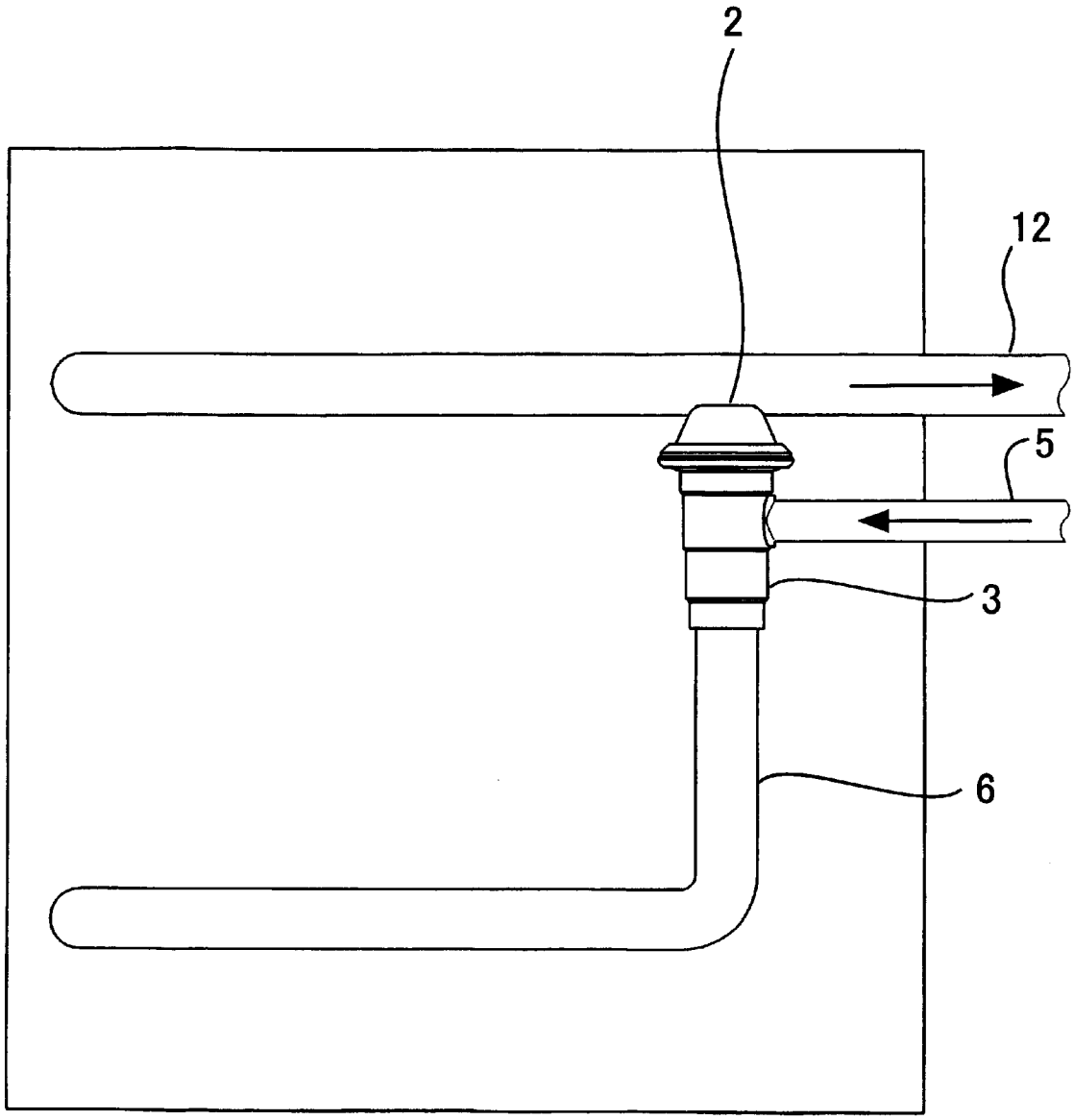
FIG. 25 is a front view of the evaporator connected with the assembled expansion valve.

FIG. 23 is an exploded view showing a state before an expansion valve according to a ninth embodiment of the present invention is assembled, FIG. 24 is a side view of the evaporator connected with the assembled expansion valve, and FIG. 25 is a front view of the evaporator connected with the assembled expansion valve. In these figures, identical reference numerals are used to denote elements identical with those appearing in FIGS. 20 to 22, and detailed description of such elements is omitted.

The manner of assembling the expansion valve of the ninth embodiment will be now described. Like the expansion valve of the eighth embodiment, the evaporator 7 is formed integrally with the valve casing 3, the high-pressure and low-pressure refrigerant pipes 5 and 6, and the outlet pipe 12. Portions of the low-pressure refrigerant pipe 6 and the outlet pipe 12 extending parallel to the front face of the evaporator 7 are located at an equal distance from the front face, while a portion of the low-pressure refrigerant pipe 6 joined integrally with the valve casing 3 in alignment therewith is tilted outward in a direction away from the front face of the evaporator 7.

To assemble the expansion valve, first, the expansion valve unit 2 is inserted into the valve casing 3, as indicated by arrow 51. In this case, the expansion valve unit 2 is inserted into the valve casing 3 in a manner such that the high-pressure refrigerant passage 18 in the body 17 is aligned with the high-pressure refrigerant pipe 5 and that the pipe receiving portion 47 of the temperature-sensitive chamber 13 is orientated in the same direction as the outlet pipe 12. Subsequently, the tilted portion of the low-pressure refrigerant pipe 6 is raised to an upright position, as indicated by arrow 52, so as to be parallel with the front face of the evaporator 7. At this time, the outlet pipe 12 passes over the inclined surface of the housing 14 of the temperature-sensitive chamber 13 and fits in the recessed pipe receiving portion 47.

Consequently, the expansion valve unit 2 receives a load on contact with the outlet pipe 12 and thus is prevented from being detached from the valve casing 3, and also since the temperature-sensitive chamber 13 is held in urging contact with the outlet pipe 12, the temperature of the refrigerant flowing through the outlet pipe 12 is transmitted directly to the temperature-sensitive chamber 13.

Figure 26:
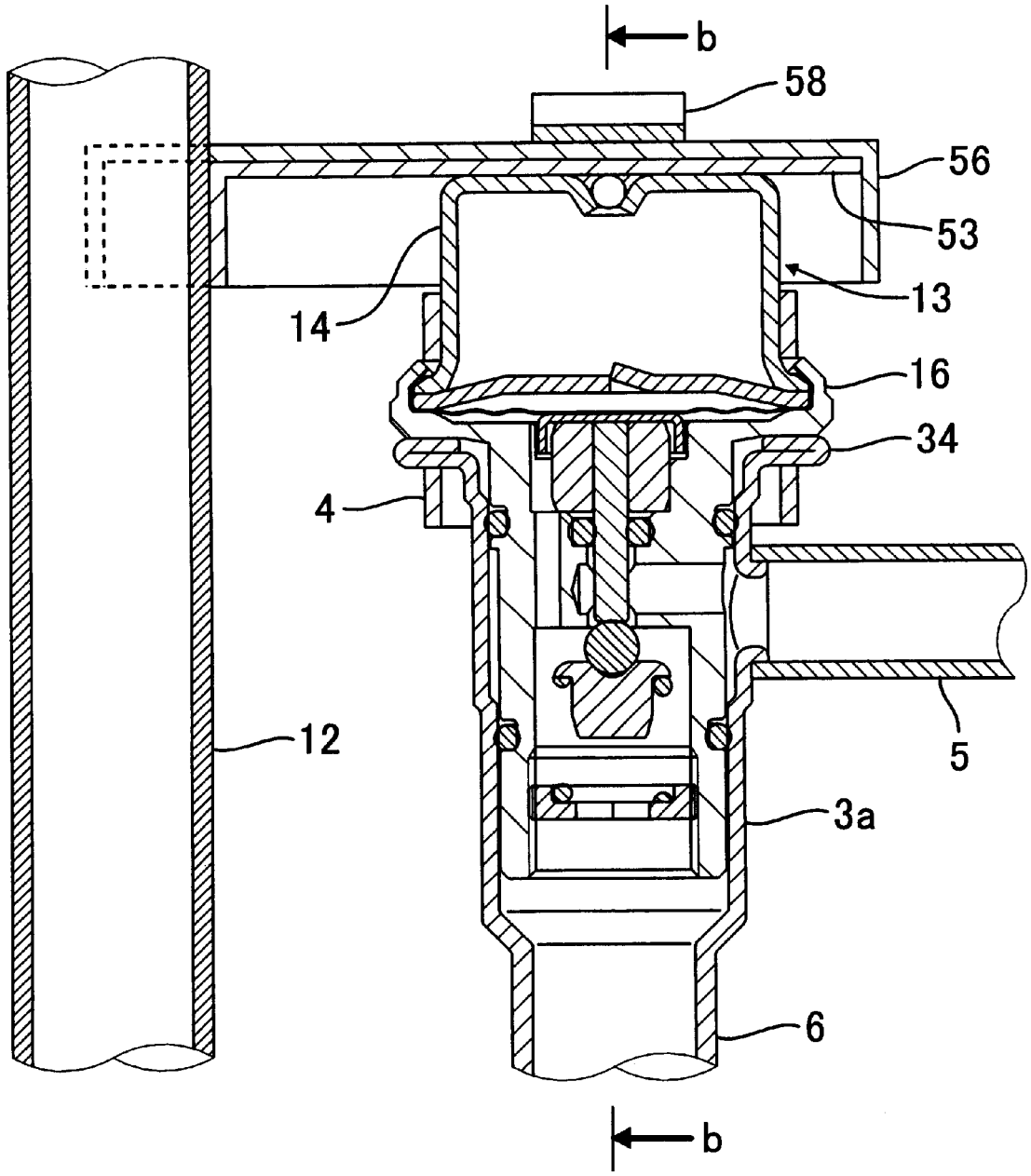
FIG. 26 is a longitudinal sectional view of an expansion valve according to a tenth embodiment of the present invention.
Figure 27:
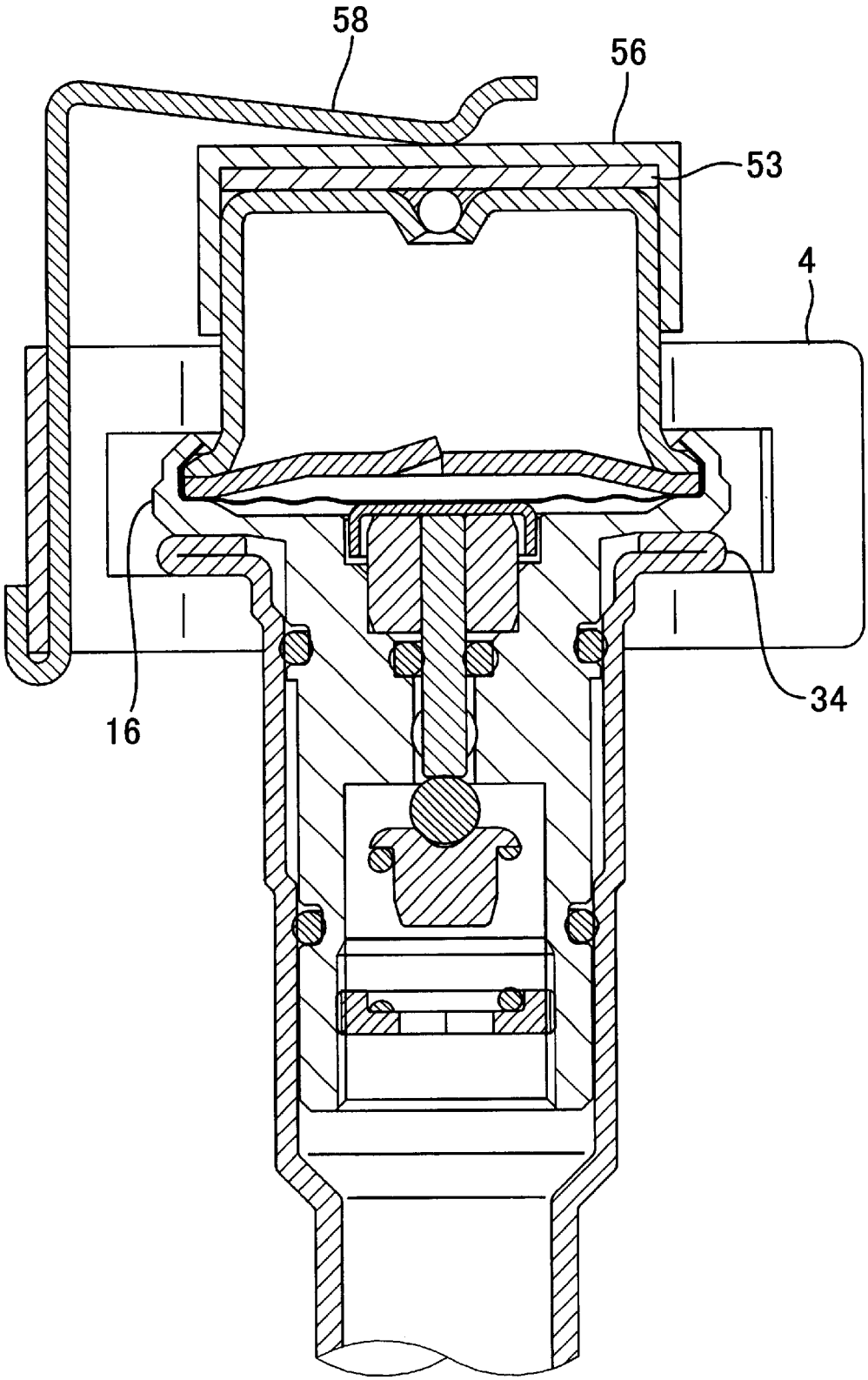
FIG. 27 is a sectional view taken along line b—b in FIG. 26.
Figure 28:
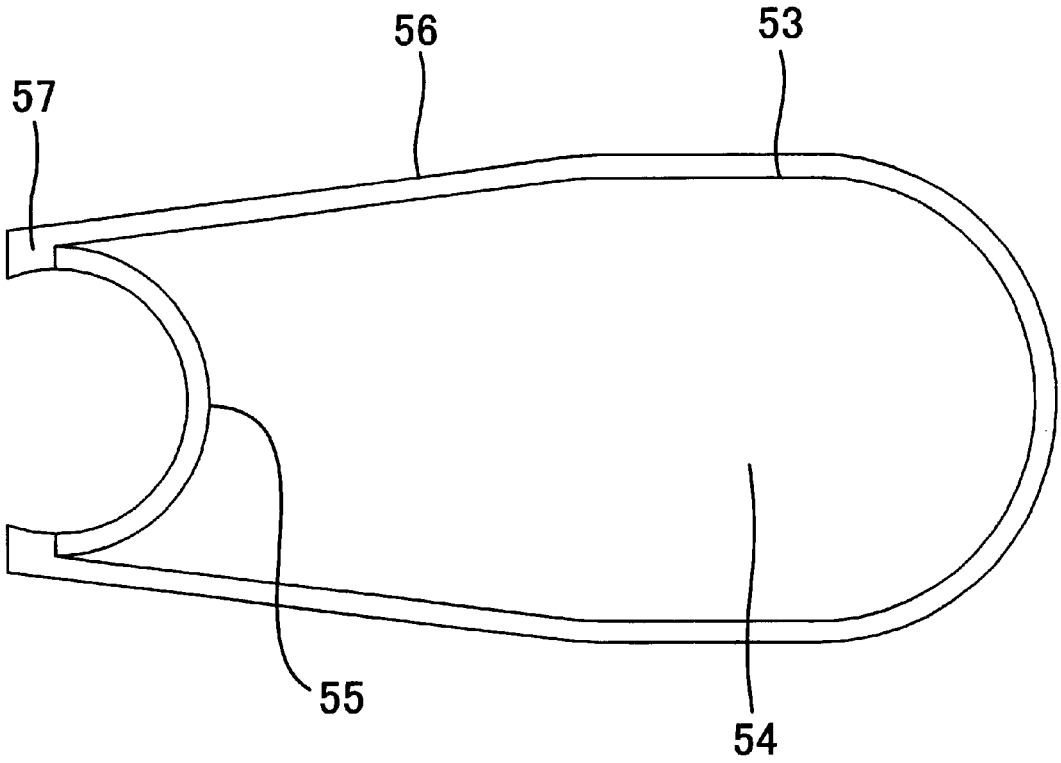
FIG. 28 is a bottom view showing an external appearance of a heat conducting member.

FIG. 26 is a longitudinal sectional view of an expansion valve according to a tenth embodiment of the present invention, FIG. 27 is a sectional view taken along line b—b in FIG. 26, and FIG. 28 is a bottom view showing an external appearance of a heat conducting member. In these figures, identical reference numerals are used to denote elements identical with those appearing in FIGS. 1 and 10, and detailed description of such elements is omitted.

In the expansion valve of the tenth embodiment, a heat conducting member 53 is placed on the housing 14 of the temperature-sensitive chamber 13 and has one end disposed in contact with the outlet pipe 12 of the evaporator 7.

The heat conducting member 53 is made of a material having high heat conductivity, such as copper or copper alloy. As shown in FIG. 28, the heat conducting member comprises a flat temperature-sensitive chamber contact portion 54 disposed in contact with the entire flat top face of the housing 14 of the temperature-sensitive chamber 13, to ensure sufficient contact with the housing 14, and a semicylindrical pipe contact portion 55 raised at one end of the temperature-sensitive chamber contact portion 54 and having an end face with a curvature equal to that of the outer periphery of the outlet pipe 12 of the evaporator 7.

Also, the heat conducting member 53 has an upper surface covered with a heat insulating cover 56. The heat insulating cover 56 is made of a resin having low heat conductivity and is preferably formed integrally with the heat conducting member 53 by insert molding. The heat insulating cover 56 prevents heat from being radiated from the heat conducting member 53 and also prevents the heat conducting member from being influenced by the ambient temperature. Also, the heat insulating cover 56 has engaging portions 57 disposed at two side edges of the semicylindrical pipe contact portion 55 and having inner side faces with a curvature equal to that of the pipe contact portion 55. The engaging portions 57 serve to keep the pipe contact portion 55 of the heat conducting member 53 in contact with the outlet pipe 12, and also to fix the pipe contact portion 55 to the outlet pipe 12.

Further, the heat conducting member 53 placed on the housing 14 of the temperature-sensitive chamber 13 is pressed by a presser lever 58 so that the temperature-sensitive chamber contact portion 54 may be held in urging contact with the top face of the housing 14 of the temperature-sensitive chamber 13. The presser lever 58 is made of a hard material having elasticity, and has one end portion engaged with the clip 4 and the other end portion disposed to press the heat conducting member 53 from above the heat insulating cover 56 against the housing 14 by means of its elasticity.

Figure 29:
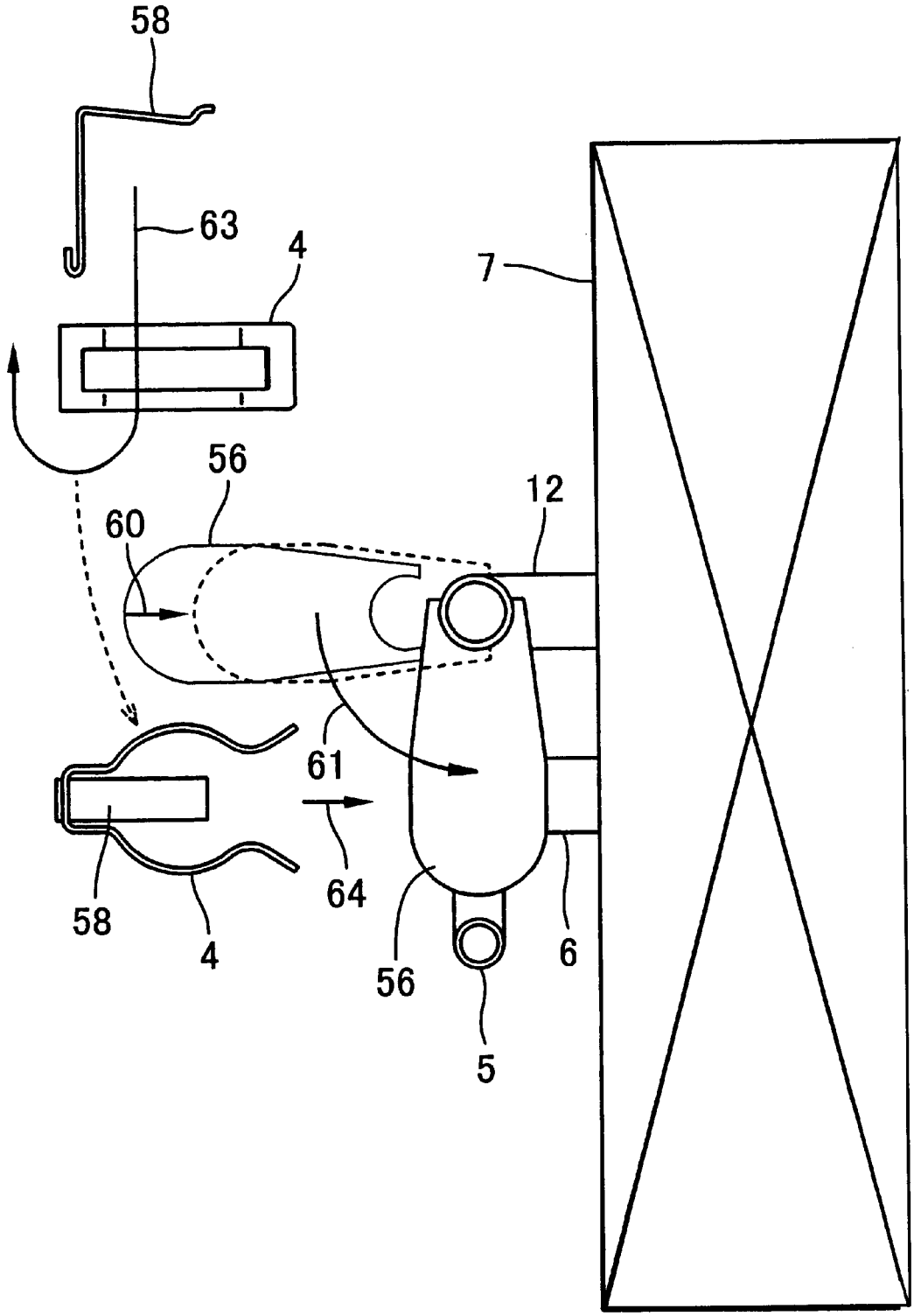
FIG. 29 is a side view of the evaporator, illustrating a manner of assembling the expansion valve according to the tenth embodiment of the present invention.
Figure 30:
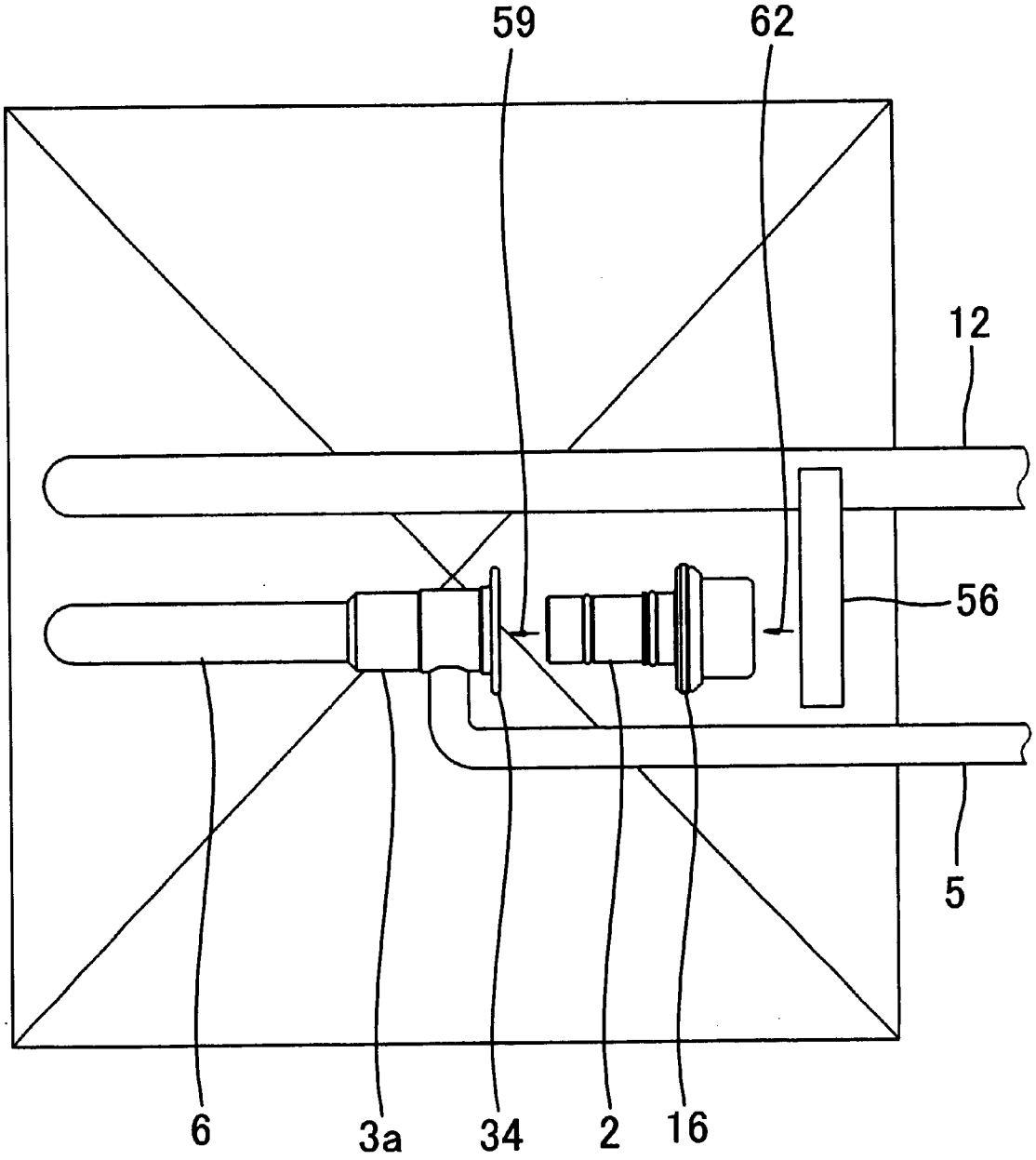
FIG. 30 is a front view of the evaporator, also illustrating the manner of assembling the expansion valve according to the tenth embodiment of the present invention.
Figure 31:
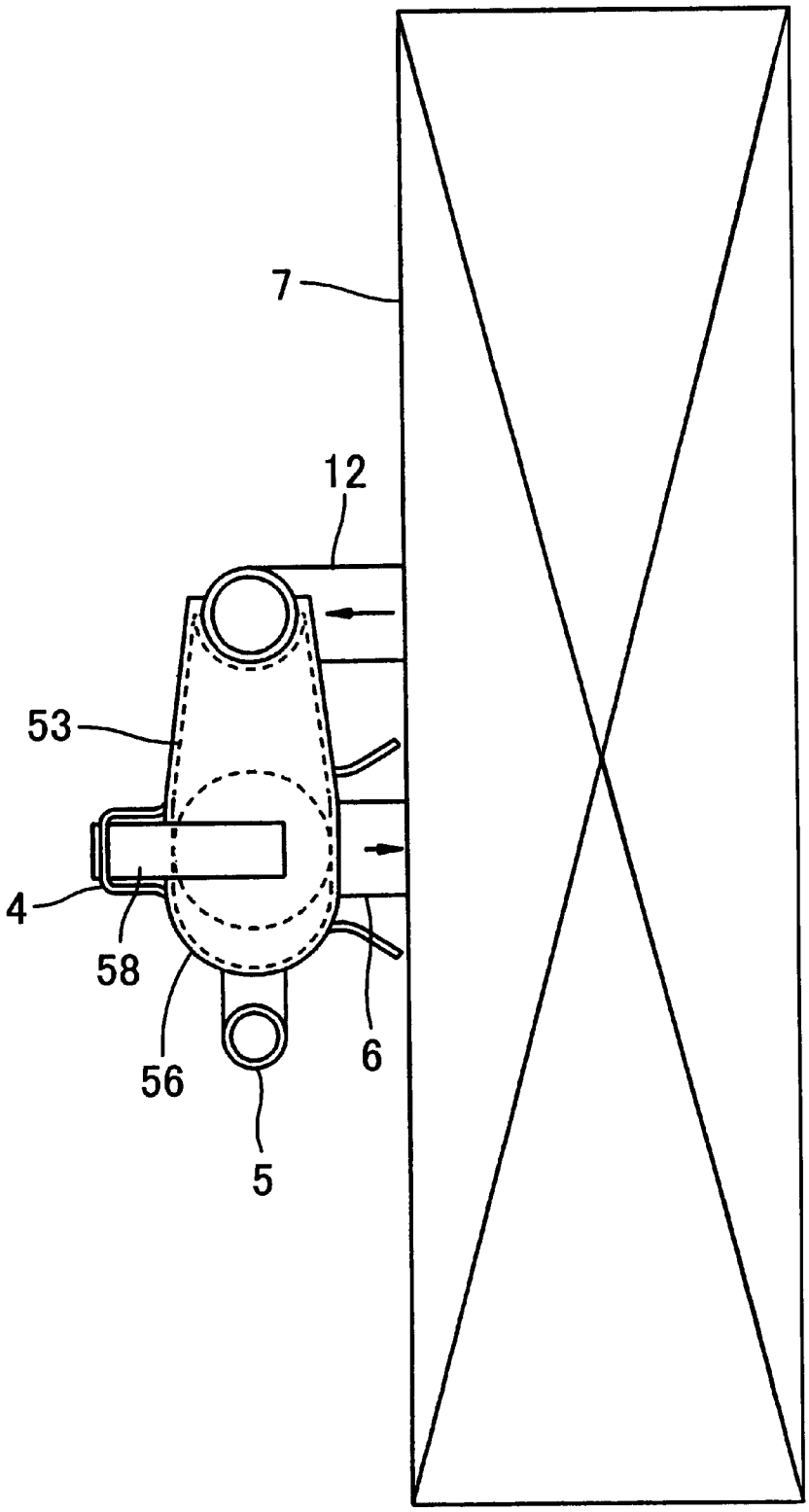
FIG. 31 is a side view of the evaporator connected with the assembled expansion valve.
Figure 32:
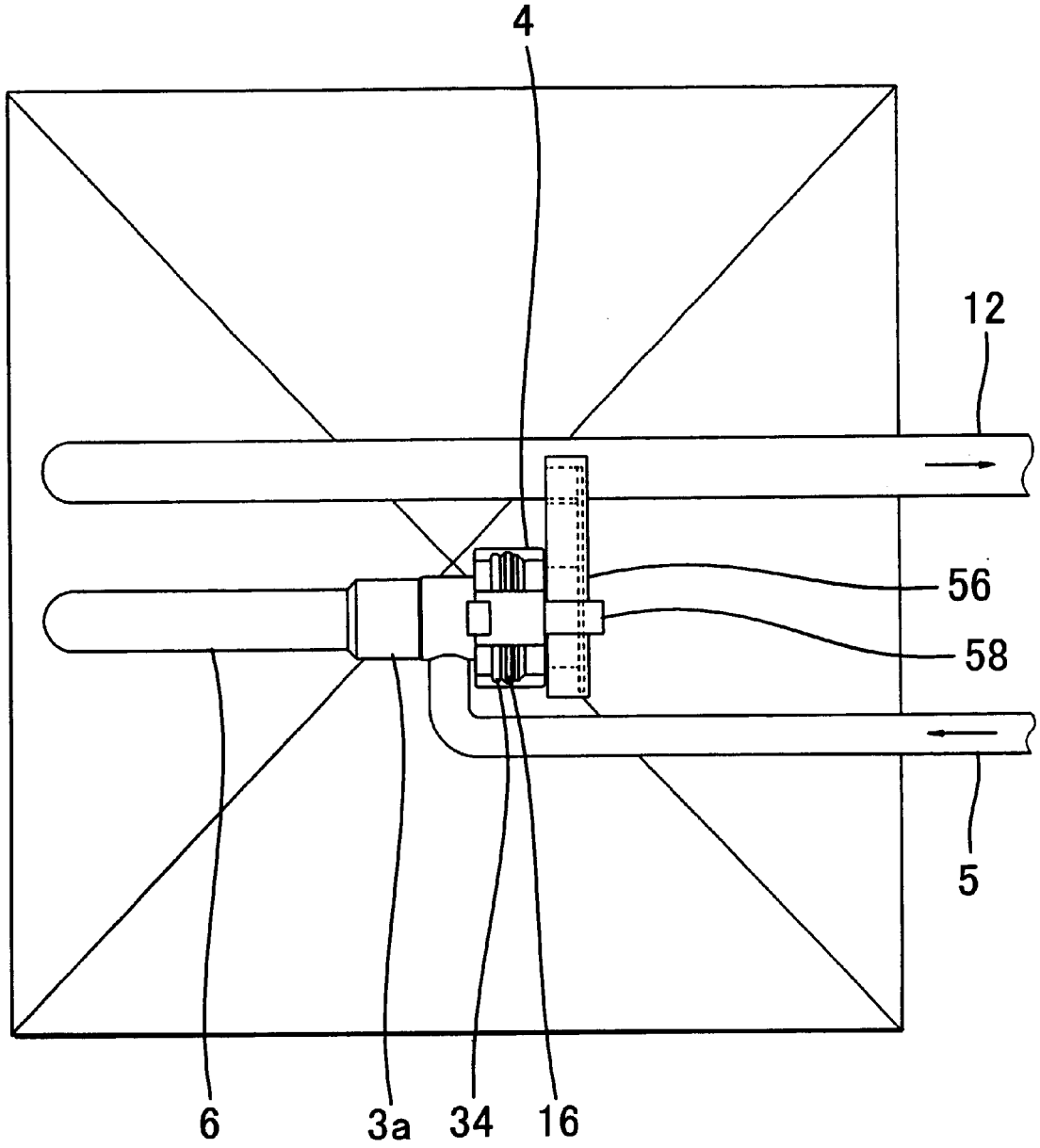
FIG. 32 is a front view of the evaporator connected with the assembled expansion valve.

FIG. 29 is a side view of the evaporator, illustrating the manner of assembling the expansion valve according to the tenth embodiment of the present invention, FIG. 30 is a front view of the evaporator, also illustrating the manner of assembling the expansion valve of the tenth embodiment, FIG. 31 is a side view of the evaporator connected with the assembled expansion valve, and FIG. 32 is a front view of the evaporator connected with the assembled expansion valve.

The manner of assembling the expansion valve of the tenth embodiment will be now described. Like the expansion valve of the ninth embodiment, the evaporator 7 is formed integrally with the valve casing 3*a,* the high-pressure and low-pressure refrigerant pipes 5 and 6, and the outlet pipe 12.

To assemble the expansion valve, first, the expansion valve unit 2 is inserted into the valve casing 3*a,* as indicated by arrow 59 in FIG. 30. Subsequently, the heat conducting member 53 is attached to the outlet pipe 12 of the evaporator 7. Specifically, with the engaging portions 57 of the heat insulating cover 56 held in contact with the outlet pipe 12 of the evaporator 7, the heat insulating cover is pushed toward the outlet pipe 12, as indicated by arrow 60 in FIG. 29. As a result, the engaging portions 57 are elastically deformed outward as they are pushed beyond the thickest portion of the outlet pipe 12, whereupon the pipe contact portion 55 of the heat conducting member 53 comes into contact with the peripheral surface of the outlet pipe 12 and the engaging portions 57 hold the outlet pipe 12 therebetween, so that the heat conducting member 53 is attached to the outlet pipe 12.

Subsequently, the heat conducting member 53 and the heat insulating cover 56 are turned, as indicated by arrow 61, such that the temperature-sensitive chamber contact portion 54 of the heat conducting member 53 faces the housing 14 of the temperature-sensitive chamber 13. Then, as indicated by arrow 62, the heat conducting member 53 and the heat insulating cover 56 are moved along the outlet pipe 12 to be fitted on the housing 14 of the temperature-sensitive chamber 13.

Finally, with the presser lever 58 engaged with the clip 4, as indicated by arrow 63, the clip 4 is pushed in, as indicated by arrow 64, to fasten together the temperature-sensitive chamber mount 16 of the inserted expansion valve unit 2 and the flange 34 of the valve casing 3*a*. Thus, the temperature-sensitive chamber mount 16 of the expansion valve unit 2 and the flange 34 of the valve casing 3*a* are fixed together by the clip 4, as best shown in FIGS. 31 and 32, so that the expansion valve unit 2 is prevented from being detached from the valve casing 3*a*. Also, since the presser lever 58 presses the heat conducting member 53 and the heat insulating cover 56 against the housing 14 of the temperature-sensitive chamber 13, the temperature of the refrigerant flowing through the outlet pipe 12 is effectively transmitted to the temperature-sensitive chamber 13 via the heat conducting member 53. In this case, the heat insulating cover 56 prevents heat from being radiated from the heat conducting member 53 and also prevents the heat conducting member from being influenced by the ambient temperature.

As described above, the expansion valve of the present invention comprises an expansion valve unit having a minimum function to serve as an expansion valve, a valve casing formed integrally with the high-pressure and low-pressure refrigerant pipes and the evaporator, and capable of receiving the expansion valve unit therein, and fixing means for fixing the expansion valve unit fitted into the valve casing, wherein the expansion valve is assembled by inserting the expansion valve unit into the valve casing and then fixing the two together by the fixing means. This makes it unnecessary to use fastening members such as nuts for connecting the low-pressure and high-pressure refrigerant pipes to the valve casing. Also, since the expansion valve unit having a minimum function to serve as an expansion valve has only to be prepared, the cost of parts can be cut down. Further, the expansion valve can be assembled simply by fitting the expansion valve unit into the valve casing and fixing the two by the fixing members, so that the assembling cost can also be reduced.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. An expansion valve for sensing temperature change of a refrigerant at an outlet of an evaporator to control a flow rate of the refrigerant supplied to an inlet of the evaporator, characterized by comprising:

an expansion valve unit including a temperature-sensitive chamber whose internal pressure rises or drops in response to temperature change of the refrigerant in a low-pressure refrigerant pipe connected to the outlet of the evaporator, and a valve mechanism actuated in response to pressure rise or drop of the temperature-sensitive chamber to control the flow rate of the refrigerant supplied to the inlet of the evaporator;

a valve casing having an opening into which said expansion valve unit is fitted, said valve casing being formed integrally with a high-pressure refrigerant pipe for introducing the high-pressure refrigerant, a low-pressure refrigerant pipe for letting out the refrigerant whose flow rate has been controlled, and the evaporator; and fixing means for fixing said expansion valve unit fitted into said valve casing.

2. The expansion valve according to claim 1, characterized in that said fixing means comprises an elastic clip having arms for clamping said valve casing from a direction perpendicular to an axis of said valve casing, the arms having openings into which a flange integrally formed at the opening of said valve casing and a peripheral edge of the temperature-sensitive chamber of said expansion valve unit are fitted such that said expansion valve unit is prevented from being detached from said valve casing.

3. The expansion valve according to claim 1, characterized in that said fixing means comprises a coupling arranged so as to surround a flange integrally formed at the opening of said valve casing and a peripheral edge of the temperature-sensitive chamber of said expansion valve unit, the coupling having upper and lower end portions thereof caulked to fix the flange and the peripheral edge of the temperature-sensitive chamber to each other.

4. The expansion valve according to claim 1, characterized in that said fixing means comprises an end portion of said valve casing at the opening thereof, the end portion of said valve casing being caulked to fix a peripheral edge of the temperature-sensitive chamber of said expansion valve unit to said valve casing.

5. The expansion valve according to claim 1, characterized in that said fixing means comprises a groove formed on an outer periphery of a body of the valve mechanism, said valve casing being caulked to be fitted into the groove, thereby fixing said expansion valve unit to said valve casing.

6. The expansion valve according to claim 1, characterized in that said fixing means comprises an outlet pipe formed integrally with the evaporator, said expansion valve unit being fixed to said valve casing by a contact load applied by the outlet pipe.

7. The expansion valve according to claim 6, characterized in that the temperature-sensitive chamber of said expansion valve unit has a pipe receiving portion having a head thereof recessed to receive the outlet pipe.

8. The expansion valve according to claim 7, characterized in that the temperature-sensitive chamber of said expansion valve unit receives the outlet pipe of the evaporator at the pipe receiving portion thereof and thus is thermally coupled to the outlet pipe, to directly detect temperature of the refrigerant flowing through the outlet pipe.

9. The expansion valve according to claim 8, characterized in that the low-pressure refrigerant pipe is formed in a tilted state tilted in a direction such that a portion thereof closer to said valve casing is remoter from the evaporator, the outlet pipe being raised to an upright position to be received in the pipe receiving portion after said expansion valve unit is fitted into said valve casing.

10. The expansion valve according to claim 1, characterized in that said valve casing is formed in a manner such that a distal end portion of the low-pressure refrigerant pipe is enlarged in diameter to permit said expansion valve unit to be fitted therein.

11. The expansion valve according to claim 1, characterized in that the temperature-sensitive chamber of said expansion valve unit detects temperature of the refrigerant flowing through an outlet pipe of the evaporator by means of a temperature sensing cylinder having a distal end portion thereof thermally coupled to the outlet pipe.

12. The expansion valve according to claim 2, characterized by comprising a heat conducting member having one end engaged with the clip and another end engaged with an outlet pipe of the evaporator, the heat conducting member being thermally coupled at a portion thereof close to the clip to the temperature-sensitive chamber of said expansion valve unit.

13. The expansion valve according to claim 2, characterized by comprising a heat conducting member having one end disposed in surface contact with the temperature-sensitive chamber of said expansion valve unit and another end disposed in surface contact with an outlet pipe of the evaporator, and an elastic presser member having one end engaged with the clip and another end pressing the heat conducting member against the temperature-sensitive chamber of said expansion valve unit.

14. The expansion valve according to claim 13, characterized by comprising a heat insulating cover covering the heat conducting member and having low heat conductivity, to prevent heat from being radiated from the heat conducting member and also to prevent the heat conducting member from being influenced by ambient temperature.

15. The expansion valve according to claim 14, characterized in that said heat insulating cover has an engaging portion for holding the outlet pipe to maintain a state of contact between the heat conducting member and the outlet pipe.

16. An expansion valve for sensing temperature change of a refrigerant at an outlet of an evaporator to control a flow rate of the refrigerant supplied to an inlet of the evaporator comprising:

an expansion valve unit including a temperature-sensitive chamber whose internal pressure rises or drops in response to temperature change of the refrigerant in a low-pressure refrigerant pipe connected to the outlet of the evaporator, and a valve mechanism actuated in response to pressure rise or drop of the temperature-sensitive chamber to control the flow rate of the refrigerant supplied to the inlet of the evaporator;

a valve casing having an opening into which said expansion valve unit is fitted, said valve casing being formed integrally with a high-pressure refrigerant pipe for introducing the high-pressure refrigerant, a low-pressure refrigerant pipe for letting out the refrigerant whose flow rate has been controlled, and the evaporator; and an elastic clip having arms for clamping said valve casing from a direction perpendicular to an axis of said valve casing, the arms having openings into which a flange integrally formed at the opening of said valve casing and a peripheral edge of the temperature-sensitive chamber of said expansion valve unit are fitted such that said expansion valve unit is prevented from being detached from said valve casing.

17. The expansion valve according to claim 16, further comprising a heat conducting member having one end engaged with the clip and another end engaged with an outlet pipe of the evaporator, the heat conducting member being thermally coupled at a portion thereof close to the clip to the temperature-sensitive chamber of said expansion valve unit.

18. The expansion valve according to clam 16, further comprising a heat conducting member having one end disposed in surface contact with the temperature-sensitive chamber of said expansion valve unit and another end disposed in surface contact with an outlet pipe of the evaporator, and an elastic presser member having one end engaged with the clip and another end pressing the heat conducting member against the temperature-sensitive chamber of said expansion valve unit.

19. The expansion valve according to claim 18, characterized by comprising a heat insulating cover covering the heat conducting member and having low heat conductivity, to prevent heat from being radiated from the heat conducting member and also to prevent the heat conducting member from being influenced by ambient temperature.

20. The expansion valve according to claim 19, characterized in that said heat insulating cover has an engaging portion for holding the outlet pipe to maintain a state of contact between the heat conducting member and the outlet pipe.

* * * * *

UNITED STATES PATENT AND TRADEMARK OFFICE

CERTIFICATE OF CORRECTION

PATENT NO. : 6,484,950 B2
DATED : November 26, 2002
INVENTOR(S) : Hisatoshi Hirota et al.

It is certified that error appears in the above-identified patent and that said Letters Patent is hereby corrected as shown below:

Title page,
Item [73], Assignee, replace "TGK Co. Ltd., Tokyo (JP)" with
-- TGK Co., Ltd., Tokyo (JP) --.

Signed and Sealed this

Twenty-seventh Day of May, 2003

JAMES E. ROGAN
*Director of the United States Patent and Trademark Office*